US011107330B1

(12) United States Patent
Barksdale et al.

(10) Patent No.: US 11,107,330 B1
(45) Date of Patent: Aug. 31, 2021

(54) NETWORKED GAMING SYSTEM ENABLING A PLURALITY OF PLAYER STATIONS TO PLAY INDEPENDENT GAMES WITH ONLINE PLAY

(71) Applicant: Dynamic Gaming Systems LLC, Egg Harbor Township, NJ (US)

(72) Inventors: Charles Barksdale, Egg Harbor, NJ (US); Jon Morosky, Bethlehem, PA (US)

( * ) Notice: Subject to any disclaimer, the term of this patent is extended or adjusted under 35 U.S.C. 154(b) by 5 days.

(21) Appl. No.: 16/266,220

(22) Filed: Feb. 4, 2019

Related U.S. Application Data

(63) Continuation of application No. 15/247,780, filed on Aug. 25, 2016, now Pat. No. 10,235,844, which is a continuation of application No. 13/850,136, filed on Mar. 25, 2013, now Pat. No. 9,449,461.

(60) Provisional application No. 61/615,342, filed on Mar. 25, 2012, provisional application No. 61/624,393, filed on Apr. 15, 2012, provisional application No. 61/644,431, filed on May 9, 2012, provisional application No. 61/664,716, filed on Jun. 26, 2012, provisional application No. 61/681,606, filed on Aug. 9, 2012.

(51) Int. Cl.
*G07F 17/32* (2006.01)

(52) U.S. Cl.
CPC ..... *G07F 17/3293* (2013.01); *G07F 17/322* (2013.01); *G07F 17/3209* (2013.01); *G07F 17/3211* (2013.01); *G07F 17/3225* (2013.01); *G07F 17/3248* (2013.01)

(58) Field of Classification Search
CPC ..... G07F 17/3293; G07F 17/3209; G07F 17/3211; G07F 17/322; G07F 17/3225; G07F 17/3248
See application file for complete search history.

(56) References Cited

U.S. PATENT DOCUMENTS

| | | | | |
|---|---|---|---|---|
| 7,175,179 | B2 | 2/2007 | Marks | |
| 7,618,043 | B1 | 11/2009 | Hayden | |
| 9,472,059 | B1 | 10/2016 | Barksdale | |
| 9,865,137 | B1 | 1/2018 | Barksdale | |
| 10,109,157 | B1 | 10/2018 | Barksdale | |
| 2003/0003997 | A1* | 1/2003 | Vuong | G07F 17/3239 463/42 |
| 2003/0114209 | A1 | 6/2003 | Ritner, Jr. | |
| 2005/0035548 | A1 | 2/2005 | Yoseloff | |
| 2005/0127606 | A1 | 6/2005 | Snow | |
| 2005/0164760 | A1 | 7/2005 | Moody | |
| 2005/0253338 | A1 | 11/2005 | Daines | |
| 2007/0060326 | A1* | 3/2007 | Juds | G07F 17/3239 463/29 |
| 2007/0298854 | A1 | 12/2007 | Yoseloff | |
| 2008/0064467 | A1 | 3/2008 | Reiner | |
| 2009/0305761 | A1 | 12/2009 | Jackson | |
| 2012/0139182 | A1 | 6/2012 | Poon | |
| 2012/0252548 | A1 | 10/2012 | Love | |
| 2012/0270637 | A1 | 10/2012 | Lutnick | |
| 2013/0130764 | A1 | 5/2013 | Costa | |

FOREIGN PATENT DOCUMENTS

WO WO-2009100582 A1 8/2009

* cited by examiner

*Primary Examiner* — Corbett B Coburn

(57) ABSTRACT

A system for and method of conducting the operations of a wagering game including player stations that permit a game player to tip a game dealer.

20 Claims, 32 Drawing Sheets

NETWORKED GAMING SYSTEM ENABLING A PLURALITY OF PLAYER STATIONS TO PLAY INDEPENDENT GAMES WITH ONLINE PLAY

CROSS REFERENCE TO RELATED APPLICATIONS

This application claims benefit to U.S. provisional application 61/615,342, filed on Mar. 25, 2012, which is incorporated by reference herein in its entirety. This application claims benefit to U.S. provisional application 61/624,393, filed on Apr. 15, 2012, which is incorporated by reference herein in its entirety. This application claims benefit to U.S. provisional application 61/644,431, filed on May 9, 2012, which is incorporated by reference herein in its entirety. This application claims benefit to U.S. provisional application 61/664,716, filed on Jun. 26, 2012, which is incorporated by reference herein in its entirety. This application claims benefit to U.S. provisional application 61/681,606, filed on Aug. 9, 2012, which is incorporated by reference herein in its entirety. This application claims benefit to U.S. application Ser. No. 13/850,136, now U.S. Pat. No. 9,449,461, which is incorporated by reference in its entirety. This application is a continuation of U.S. application Ser. No. 15/247,780, filed on Aug. 25, 2016, which is incorporated by reference herein in its entirety.

BACKGROUND OF THE INVENTION

Field of the Invention

The present general inventive concept is directed to a method, apparatus, and computer readable storage medium directed to a networked gaming system that allows an unlimited number of players to bet on simultaneous live dealers.

Description of the Related Art

Casino gaming is a multi-billion dollar industry. Currently players can play table games (such as blackjack, baccarat, etc.) at dedicated tables with a dealer. A main drawback of this paradigm is the increasing overhead that the casino is responsible for each table (e.g., paying the dealer, pit staff, surveillance, etc.) Because of the large overhead, it may be impractical for casinos to offer live table games that have low minimum wagers. For example, it is rare to see a $5 minimum blackjack or baccarat table game these days at a casino.

A cheaper alternative for casinos is to use video table game machines which can use a virtual (electronic) dealer to deal games such as baccarat and blackjack without requiring human resources. A drawback to this approach is that many players do not take well to these machines as they prefer to see a live human dealer deal the game. Additionally, some players mistrust the use of such machines as they suspect the results may be rigged by the house. A virtual game's outcome is predetermined by computer, whereas a live dealer game outcome, using a fair deck of cards, occurs naturally (the outcome is not predetermined prior to the dealing of cards).

Therefore, what is needed is a system that allows players to play table games with human dealers but reduces the amount of overhead required for such games, thereby making it practical to offer live table games with low table minimums.

SUMMARY OF THE INVENTION

It is an aspect of the present invention to provide a system to facilitate a networking wagering game.

The above aspects can be obtained by an apparatus that includes (a) a first dealer station comprising a first table and a first video camera configured to capture video of a first blackjack game on the first table; (b) a second dealer station comprising a second table and a second video camera configured to capture video of a second blackjack game on the second table; (c) a first player station comprising a display of the video of the first table, a display of the video of the second table, and a betting area configured to receive wagers from a player at the player station on both the first blackjack game and the second blackjack game; (d) a second player station comprising a display of the video of the first table, a display of the video of the second table, and a betting area configured to receive wagers from a player at the player station on both the first blackjack game and the second blackjack game; and (e) a server operationally connected to the first dealer station, the second dealer station, the first player station, and the second player station, and configured to resolve wagers placed at the first player station on the first blackjack game and the second blackjack game and the second player station on the first blackjack game and the second blackjack game, (f) wherein the server is further configured to enable a first player at the first player station to utilize a first playing strategy on the first blackjack game while a second player at the second player station utilizes a second player strategy, the first playing strategy being different from the second playing strategy.

The above aspects can also be obtained by a method that includes (a) receiving first player wagers from a first player at a first player station on a first blackjack game and on a second blackjack game; (b) receiving second player wagers from a second player at a second player station on the first blackjack game and the second blackjack game; (c) a first dealer dealing the first blackjack game at a first dealer station; (d) a second dealer dealing the second blackjack game at a second dealer station; (e) transmitting video of the first game and the second game to the first player station and the second player station; (f) enabling the first player to complete the first blackjack game and the second blackjack game at the first player station, wherein the first player can choose playing strategy for the first game and the second game; (g) enabling the second player to complete the second blackjack game and the second blackjack game at the second player station, wherein the second player can choose playing strategy for the first game and the second game; and (h) resolving the first player wagers and the second player wagers based on outcomes of the first game and the second game.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
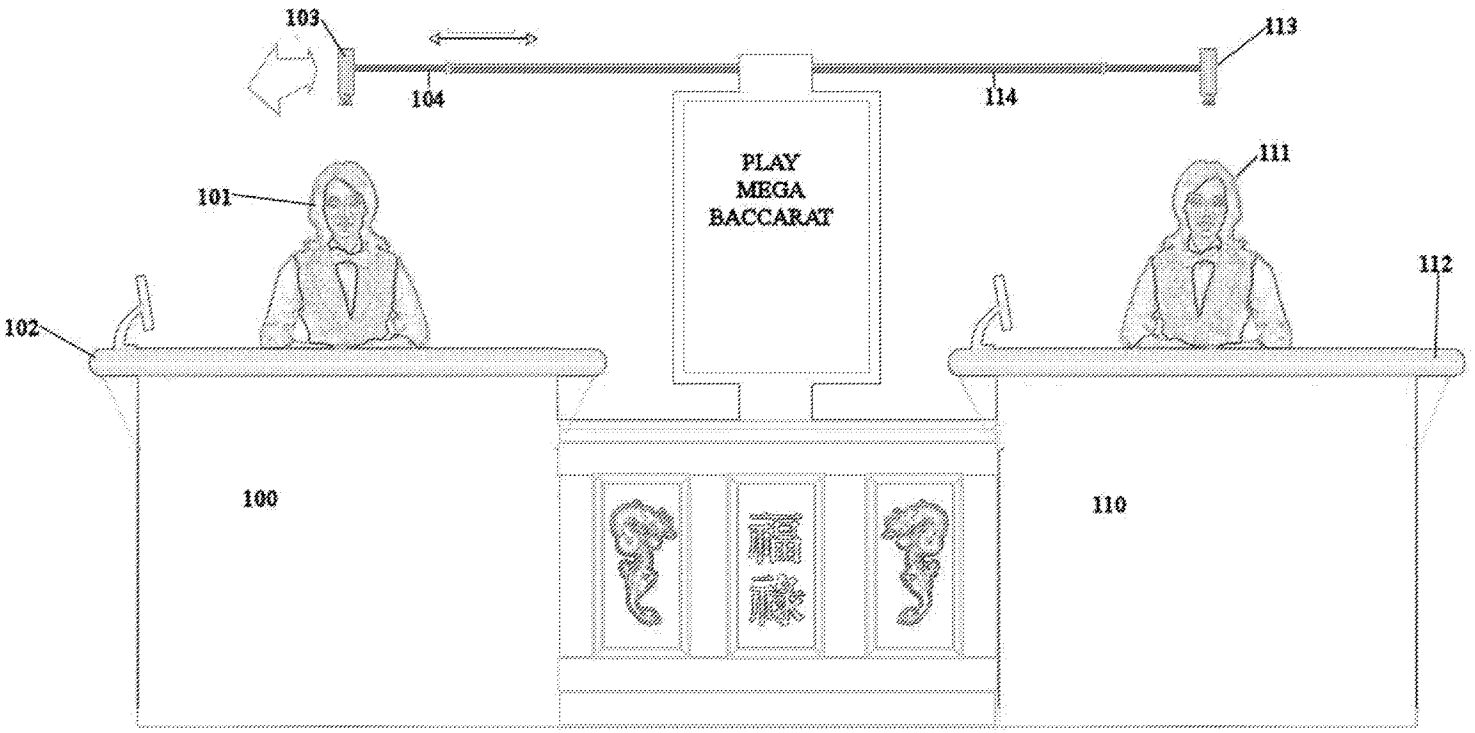
FIG. 1 is a drawing of two networked dealer stations, according to an embodiment.

Reference will now be made in detail to the presently preferred embodiments of the invention, examples of which are illustrated in the accompanying drawings, wherein like reference numerals refer to like elements throughout.

The present inventive concept relates to a method, apparatus, and computer readable storage medium to implement a casino gaming system that allows players to bet on simultaneous dealers. The system can be used with most casino type game, such as baccarat, blackjack, craps, etc. The system provides at least two dealer stations, each dealer station (also referred to as dealer terminal) including the equipment needed to deal a casino game (e.g., table, felt, cards, shuffler, etc.) Each dealer station is also equipped to be videographed so that live videos of the two or more dealers can be simultaneously broadcast to a plurality of player stations. In this way, each player at a player station can make wagers on at least two dealer stations independently.

This system is advantageous for numerous reasons. Allowing players to bet on more than one game simultaneously provides a more exciting gaming experience for the player. This also allows the house to collect more action (and hence more profits) than if players were able to only bet on one game at a time. In addition, an unlimited number of players can make bets on the two games while only two human dealers are needed, reducing overhead for the casino. There is no limit to the number of player stations that can be used (with typically one player per player station) at a casino or even remotely at other casino locations. Players can also make wagers on the games at the two dealer stations remotely via the Internet using computers, hand-held devices, or smartphones The system herein can be applied to most casino games, such as baccarat or blackjack. Casino blackjack is well known in the art, for example see U.S. patent publication 2003/0155715, which is incorporated by reference herein in its entirety.

Baccarat is well known in the art, for example see U.S. Pat. No. 6,299,171 and U.S. pre-grant publication 2008/

0032760, both documents of which are incorporated by reference herein in their entireties.

The rules of standard Baccarat are summarized in Table I below.

TABLE I

1) Usually eight decks of cards are used.
2) Cards are given point values as follows: ace = 1, 2-9 = pip value, 10 and face cards = 0.
3) At the start of a new shoe, the dealer will turn over one card. This will determine how many cards the dealer will burn, according to the baccarat value, except a 10 or face card will result in 10 cards burned.
4) The cut card will be placed 16 cards from the bottom of the shoe. When the cut card appears, the dealer will finish that hand, play one more hand, and then start a new shoe. If the cut card comes out instead of the first card, the dealer will finish that hand, and then start a new shoe.
5) Play begins by all players betting either on the "player", "banker", and/or a tie. At some tables you may also bet on a player pair and banker pair.
6) After all bets are placed, the dealer gives two cards each to the player and the banker. The score of the hand is the right digit of the total of the cards. For example, if the two cards were an 8 and 7, then the total would be 15 and the score would be a 5. The scores will always range from 0 to 9 and it is impossible to bust.
7) A third card may or may not be dealt to either the player or the dealer depending on the following rules. A) If either the player or the banker has a total of an 8 or a 9 they both stand. This rule overrides all other rules. B) If the player's total is 5 or less, then the player hits, otherwise the player stands. C) If the player stands, then the banker hits on a total of 5 or less. If the player does hit then use Table II below to determine if the banker hits (H) or stands (S).
8) The score of the player and dealer are compared; the winner is the one that is greater. Winning bets on the banker pay 19 to 20 (or even money less a 5% commission), winning bets on the player pay 1 to 1, winning bets on a tie usually pay 8 to 1. In the event of a tie, banker and player bets will push.
9) On winning banker bets, the player will be paid even money. Meanwhile, the dealer will keep track of the 5% commission owed with small laminated markers. At the end of each shoe, or when a player wants to leave, the dealer will collect all commissions owed. Optionally, some casinos will pay 19:20 on winning banker wagers thus eliminating the need for lammers and future collection of aggregate commissions.

Table II below shows the Baccarat drawing rules for the player's third card

TABLE II

| Banker's score | player's third card 0123456789 |
|---|---|
| 7 | SSSSSSSSSS |
| 6 | SSSSSSHHSS |
| 5 | SSSSHHHHSS |
| 4 | SSHHHHHHSS |
| 3 | HHHHHHHHSH |
| 2 | HHHHHHHHHH |
| 1 | HHHHHHHHHH |
| 0 | HHHHHHHHHH |

FIG. 1 is a drawing of two networked dealer stations, according to an embodiment.

A first dealer station 100 is used to deal a wagering game such as baccarat, blackjack, etc. A first human dealer 101 deals on a first table 102 at the first dealer station 100. A first camera 103 is pointed to and records from above all of the cards dealt on the table 102 (the cards dealt are all physical). The first camera 103 is adjustable on a first track 104 and can slide in a horizontal direction as well as a forward/backward direction. The first camera 103 is also mounted on a pivot so that the first camera 103 can be adjusted and pointed in a desired direction. The signal from the first camera 103 is fed into the network so it can be processed and transmitted to all of the player stations. The first camera 103 is connected to a first video system that comprises all of the hardware needed to integrate live video from the first camera into the rest of the system. The video from the first camera 103 can optionally be recorded on a computer storage medium for later reference.

A second dealer station 110 is identical in structure to the first dealer station 100. A second human dealer 111 deals on a second table 112 at the second dealer station 110. A second camera 113 is pointed to and records from above all of the cards dealt on the table 112 (the cards dealt are all physical). The second camera 113 is adjustable on a track 114 and can slide in a horizontal direction as well as a forward/back direction. The second camera 113 is also mounted on a pivot so that the second camera 113 can be adjusted and pointed in a desired direction. The signal from the second camera 113 is fed into the network so it can be processed and transmitted to all of the player stations. The second camera 113 is connected to a first video system that comprises all of the hardware needed to integrate live video from the second camera into the rest of the system. The video from the second camera 113 can optionally be recorded on a computer storage medium for later reference.

The dealers (the first and second dealer) deal the games as a normal dealer would. The only difference between the first and second dealer and traditional dealers at a casino is that the first and second dealers typically only have to deal their cards but do not have to take and pay individual wagers. The dealers will deal games which will be streamed live to player stations who can bet individually on each of the two dealers. All dealer stations can typically be identical in structure and features.

Figure 2:
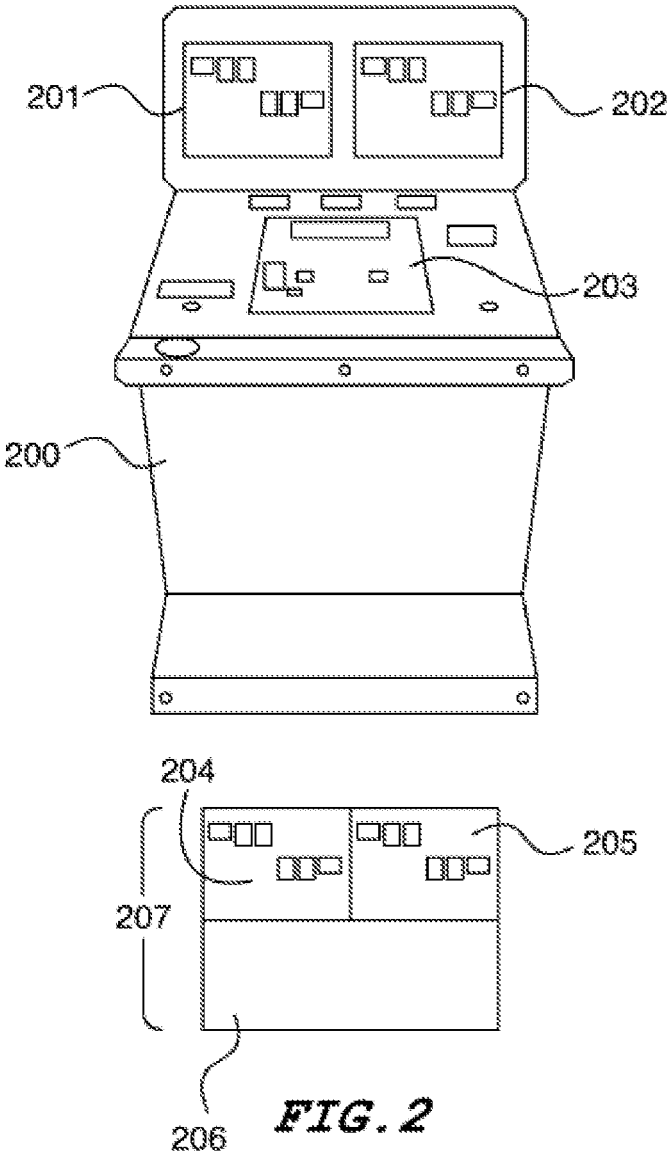
FIG. 2 is a drawing of a player station, according to an embodiment.

FIG. 2 is a drawing of a player station, according to an embodiment. Typically, each player station would be used by one player.

A player station 200 can include first table screen 201 that displays live what is happening (including the cards dealt) on the first table 100. A second table screen 202 displays live what is what is happening (including the cards dealt) on the second table 110. A betting screen 203 allows the player to place bets on a first game (which is played on the first table 100) and the second game (which is played on the second table 110). The betting screen would typically be a touch-screen monitor so that the player can make bets by touching a graphical user interface (GUI). The first table screen 201 and second table screen 202 typically do not have to be able to accept commands from the user (e.g., they can be a passive display) although in another embodiment they can also be touchscreens which can accept commands. The player station 200 can also offer the player an ability to select a different language (e.g., English, Chinese, etc.) that the player wants to see used on the betting screen 203 (and other outputs that use displayed words/numbers to relay information) so that the player can play even if the player does not speak English. Typically, all of the player stations would be identical (such as to player station 200).

In a further embodiment, a composite screen 207 (typically a touch-screen) can combine a first table screen 204 (which functions as the first table screen 201), a second table screen 205 (which functions as the second table screen 202) and a betting screen 206 (which functions as the betting screen 203) so that only one screen (physical output device) is needed for the composite screen 207. A betting area can be considered the betting screen 203 (a dedicated output device) or the betting screen 206 or a window/subsection on an output device.

Not pictured in FIG. 2 is a deposit mechanism allowing the players to fund their player station. This can be for example, a bill validator where players can insert cash into which will be automatically converted to credits on the player station so that the player can wager with these credits. A bill validator may also accept cashless tickets/vouchers as well (known as ticket-in-ticket-out, or TITO) which a player may have received from a slot machine. The player may also be able to fund their player station using an electronic payment mechanism, such as credit/debit card, electronic funds transfer, casino cash card, etc. Deposited funds can then augment the credit meter at the respective player station so that those funds can be wagered with.

Figure 3:
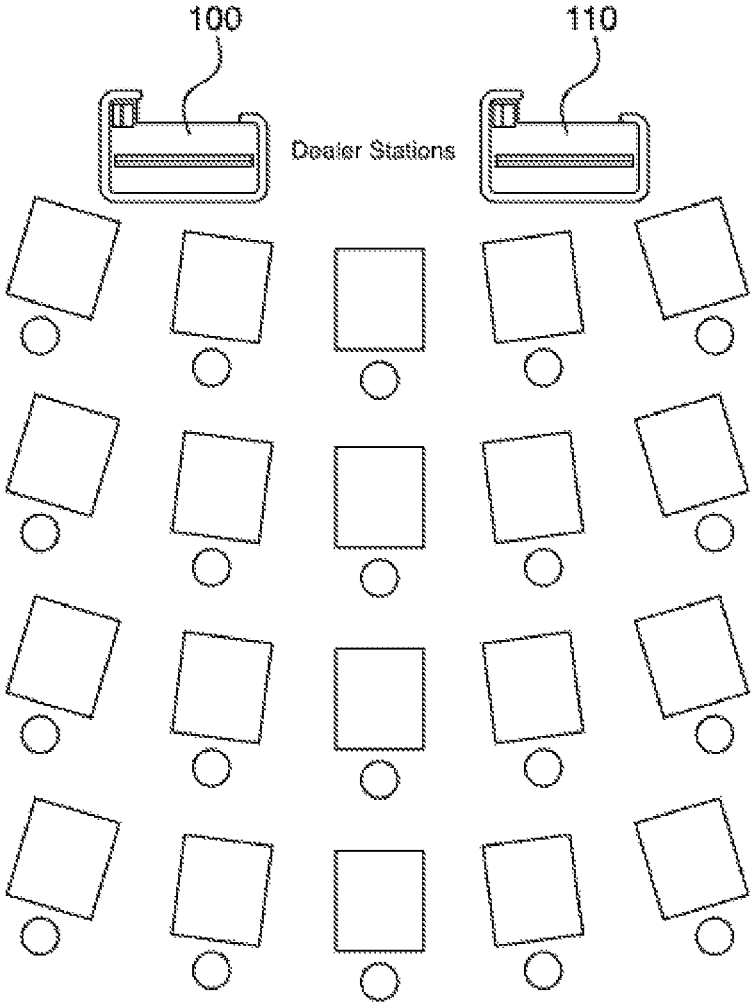
FIG. 3 is a block diagram of a layout of dealer and player stations, according to an embodiment.

FIG. 3 is a block diagram of a layout of dealer and player stations, according to an embodiment.

Shown are the first dealer station 100 and the second dealer station 110 which are connected to twenty player stations (not individually numbered). Not shown are the electrical connections connecting the dealer stations to the player stations and a back-end server enabling the system to operate. Each player station can be a player station 200 as illustrated in FIG. 2 and a stool.

Thus, players can sit down at each individual player station and make wagers individually on the first game being played at the first dealer station and the second game being played at the second dealer station. The player is free to bet on the first game and/or the second game at their choice. All player stations are typically identical.

Figure 4:
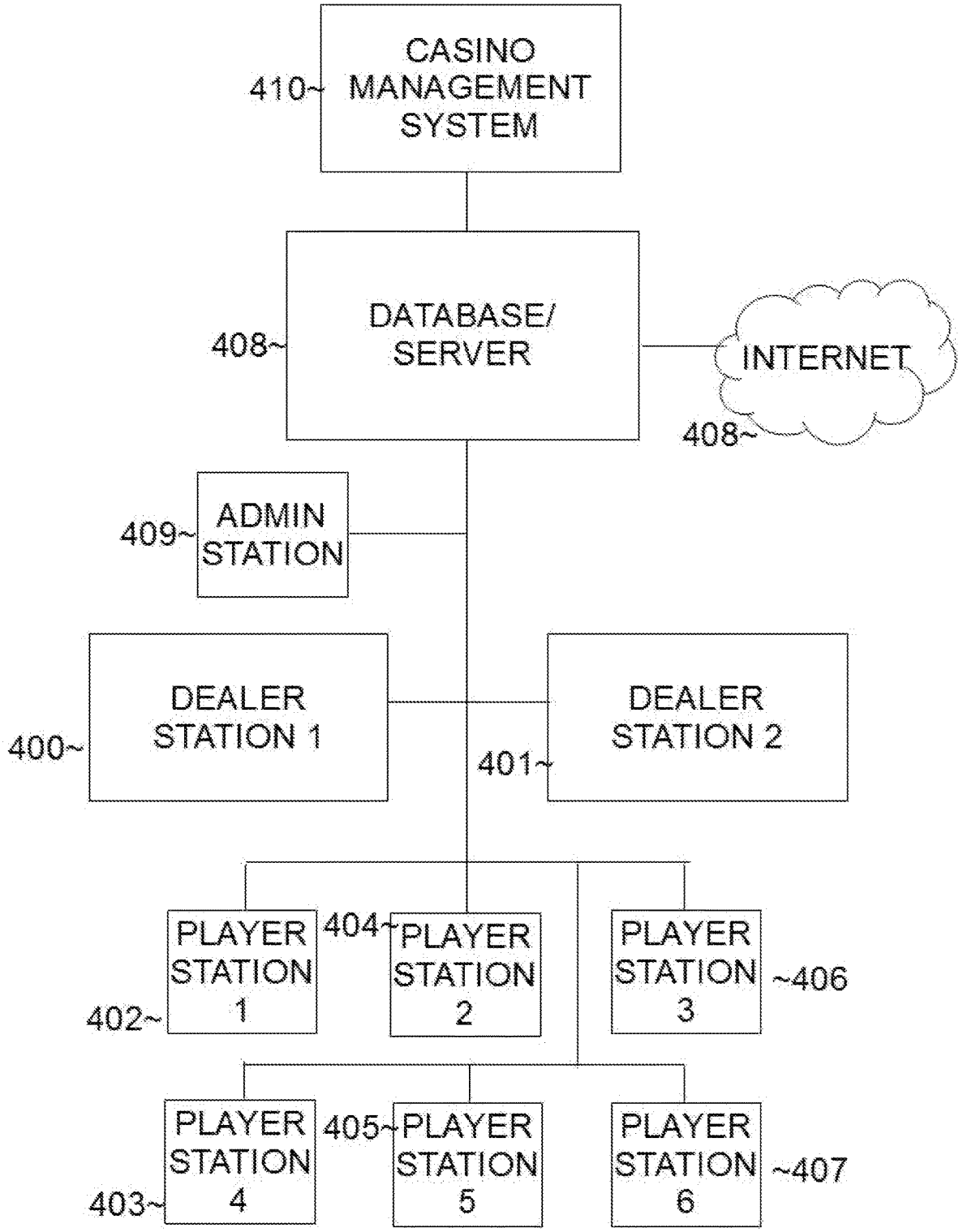
FIG. 4 is a network diagram of dealer and player stations, according to an embodiment.

FIG. 4 is a network diagram of dealer and player stations, according to an embodiment.

A dealer station 1 (can be first dealer station 100) and dealer station 2 (can be second dealer station 110) are connected to a database/server 408. The database/server 408 coordinates the entire operation of the system and can perform all of the operations of the system including receiving and logging wagers from each of the player stations; accounting for each player's wins/losses on the player stations; storing all of the video and all other information from the dealer stations; managing player accounts, and all other functions.

Player stations 402, 403, 404, 405, 406, 407 are connected to the system so that the player stations can display the video taken at dealer station 1 400 and dealer station 2 201 and accept and manage bets from players. Typically, all player stations have the same structure and offer the same features. While a player station typically has seating for only one payer, some player stations may be able to seat two or more players.

The database/server 408 is also connected to a computer communications network such as the internet 408 so that players who are using a home computer, hand-held device or smartphone at their home can still play along with the dealer station 1 400 and dealer station 2 401 in the same manner as the player stations. The players who are playing over the Internet can play for fun (play money) or for real money.

An administrative station 409 is connected to the system as illustrated in FIG. 4. The administrative station 409 provides functions to the game administrators. The game administrators are the casino personnel responsible for administering the game/system. The game administrators can access the administrative station (typically using a logon/password) so that they can change the parameters of the system, such as the maximum and minimum bets (for each type of bet) players can make at the player stations, denomination of chips available to the players at the player stations, game rule adjustments, length of countdown periods, and all other parameters. The parameters input at/from the administrative station 409 is communicated with the database/server 408 such that all other components (e.g., all player stations, dealer stations, etc.) will reflect all of the parameters changed at the administrative station 409.

The system can also be connected to the casino management system 410. The casino management system 410 is a casino-wide system that performs operations such as player tracking, game monitoring, etc. for both table games and machine games (e.g., slot machines). The system described herein can be tied in to the casino management system 410 like any other game in the casino so that the casino management system 410 can track the action taking place on the system described herein.

Figure 5:
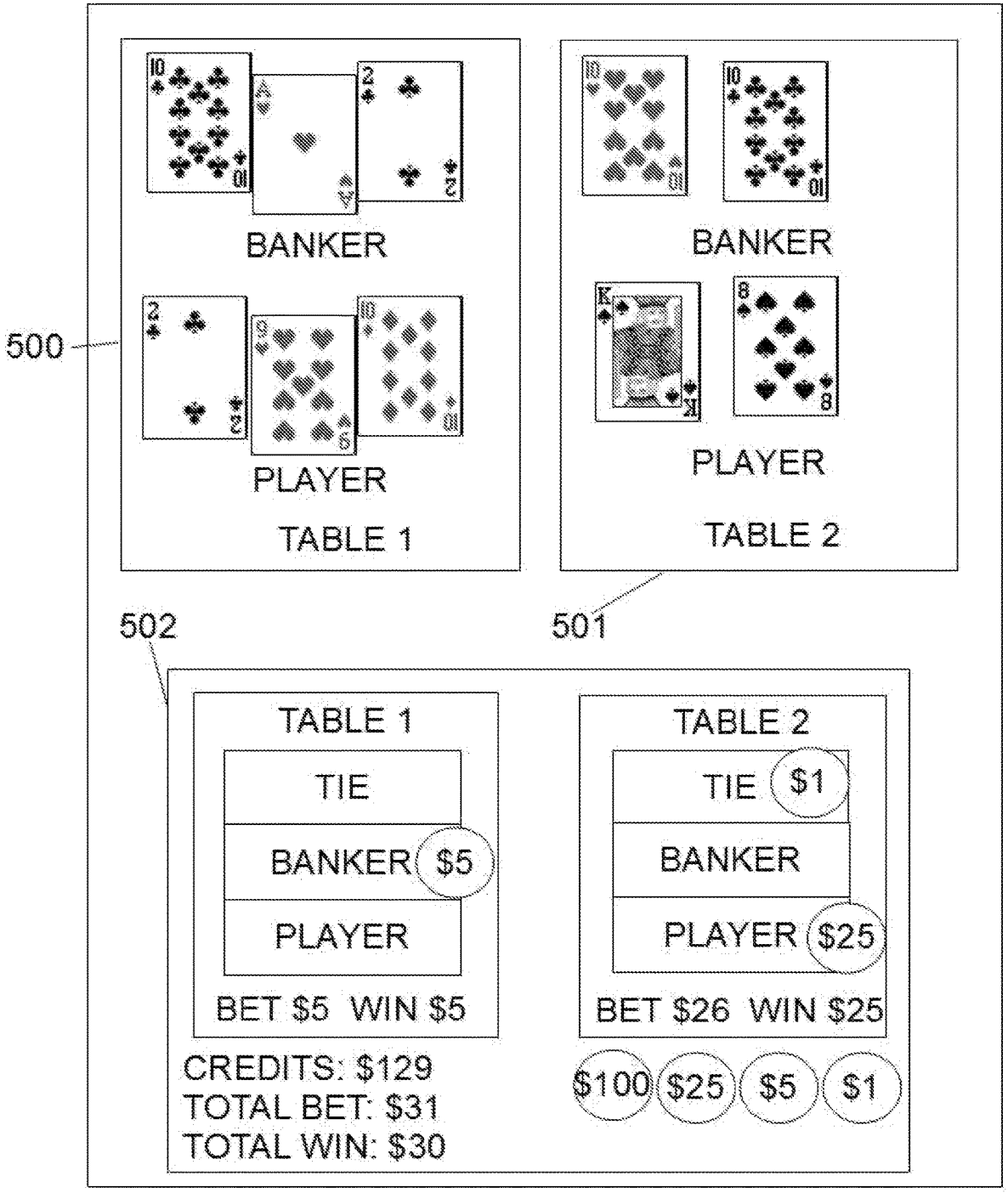
FIG. 5 is a drawing of video outputs on a player station, according to an embodiment.

FIG. 5 is a drawing of video outputs on a player station, according to an embodiment. It is noted FIG. 5 is merely one example, and numerous other configurations can be used as well.

A first table screen 500 shows what is happening on the first dealer station in real time and a second dealer screen 501 shows what is happening on the second dealer station in real time. A betting screen 502 (or betting area) allows the player using a player terminal (also referred to as player station) to make bets on a first game taking place on the first dealer station and/or a second game taking place on the second dealer station. The betting screen 502 allows a player to make bets of his choice on game one (table one) and/or game two (table two). Bets can be made on only one of these tables or both simultaneously.

For example, a player can touch one of the chip denominations and then touch (or slide to) one of the bets. In this example, the player placed a $5 chip (wager) on table 1 banker bet, a $25 chip (wager) on table 2 player bet, and a $1 chip (wager) on the table 2 tie bet. Any bets placed will be automatically resolved once the respective game has been completed. In this case, since game 1 wins for the banker bet the player here wins the $5 banker bet on table 1. Since game 2 did not result in a tie, the player loses the $1 tie bet on table 2. And since the player bet wins on table 2 the player wins the $25 player bet on table 2. After each game is dealt, the wagers will automatically be removed from the various bets so the player can make new bets for the upcoming games. Thus, all wagers are resolved automatically after their respective game has been completed. The dealers do not need to physically manipulate chips. Players are free to make any bets in any combination on each of the available bets for each game as they wish.

Typically when a game is over, there can be an interval of a predetermined time (e.g. 10 seconds) before a new game starts in order to give the player a chance to make his bets.

In order to effectuate the methods described herein, a dealer should take additional steps in order to coordinate the dealer's actions with the system at large.

Figure 6:
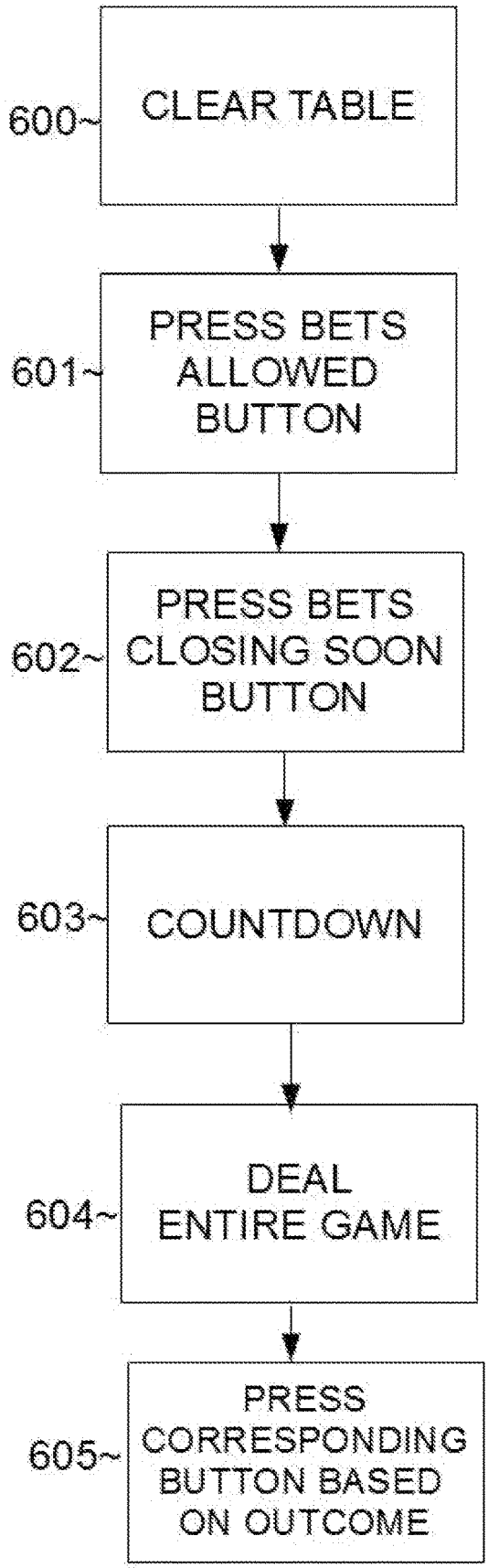
FIG. 6 is a flowchart illustrating an exemplary method of dealing a networked gaming system with simultaneous dealers, according to an embodiment.

FIG. 6 is a flowchart illustrating an exemplary method of dealing a networked gaming system with simultaneous dealers, according to an embodiment.

The method can begin with operation 600, wherein the dealer physically clears a particular table (e.g., removes all cards, clutter, etc.). This can also include shuffling the deck(s), etc. This method is performed individually for each table.

From operation 600, the method proceeds to operation 601, wherein the dealer presses a "bets allowed" button on the particular table. This is also transmitted to all of the player stations so that the stations can display that a new game is starting. This electronically instructs all of the player stations that betting is now open (bets can now be placed) on the next game on this particular table. The dealer can also clear the particular table at this point (instead of in operation 600).

From operation 601, the method proceeds to operation 602, wherein the dealer presses the "bets closing soon" button. The dealer can wait an arbitrary amount of time between operation 601 and 602 (e.g., 5 seconds). Once the dealer pushes the bets closing soon button, this starts a countdown. Players would typically have a predetermined amount of time (e.g., 10 seconds) to place a wager on the next game on the particular table before the betting is closed on this game.

From operation 602, the method proceeds to operation 603 which displays a countdown (e.g., for the 10 seconds). Each dealer station and player station can display a time countdown before the betting is closed. The players at each player station can view the countdown on the display at their station so that they know how much time they have left to place the wager for the upcoming game on the particular table before betting is closed. The dealer can also have a countdown display or a light that goes off letting the dealer know when he or she can begin dealing the game. Once the countdown is over, then betting is closed (no more bets can be placed for the next game on the particular table) and the dealer is free to start dealing the game.

From operation 603, the method proceeds to operation 604, wherein the dealer deals the entire game to completion. This can be done as known in the art for the specific game.

Figure 7:
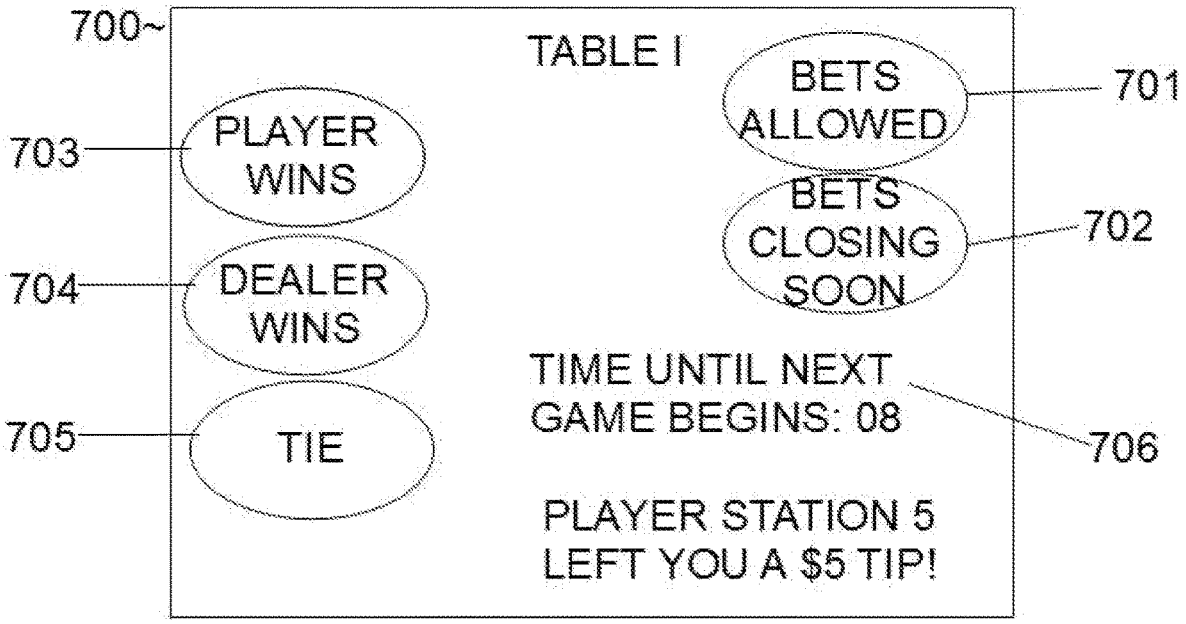
FIG. 7 is a drawing of a display and buttons on a dealer station monitor, according to an embodiment.

From operation 604, the method proceeds to operation 605, wherein the dealer presses a button based on a corresponding outcome (see FIG. 7). This button press is transmitted to the database/server and also the player stations. All wagers placed based on this game are now resolved based on the button press. For example, if in a baccarat game the banker wins then the dealer presses a "banker wins button." If the player wins then the dealer presses a "player wins button." If there is a tie the dealer presses a "tie" button. Depending on the game, different buttons would be used based on all of the possible outcomes for that game.

If there is a side bet that has numerous different payouts, then an outcome button can exist for each of the possible outcomes of the side bet that has a different payout. The database/server of course must know how to resolve all wagers placed.

FIG. 7 is a drawing of a display and buttons on a dealer station, according to an embodiment.

Each dealer station can have an interface allowing the dealer to communicate with the system. The interface can be virtual (e.g., all on a touch-screen) or can use real physical buttons combined with a display or other output device (e.g., lights, etc.)

A new game button 701 is pressed by the dealer when the dealer is ready to deal a new game (in operation 601). A bets closing soon button 702 is pressed by the dealer just before the dealer actually starts dealing a new game (in operation 603). In between when the new game button 701 and the bets closing soon button 702 is pressed, the players can make wagers on the next game to be dealt. Players may continue to place wagers until the countdown period (e.g. 10 seconds) is over.

Outcome buttons are pressed by the dealer when the game is over so that the system knows what the outcome of the game is and can resolve all the live wagers accordingly. Outcome buttons are game-specific (e.g., the outcome buttons shown are specific for the game of baccarat). A player wins button 703 is pressed by the dealer to indicate that the player has won the baccarat game (the player not meaning any of the players at the player stations, but in baccarat either a "banker" or a "player" hand wins). A banker wins button 704 is pressed by the dealer to indicate that the banker has won the baccarat game. A tie button 705 is pressed by the dealer to indicate that a tie has occurred (neither the player nor the dealer has won). Only one of these three buttons would be pressed at the conclusion of a game. All of the buttons transmit a signal to the database/server 408 so that the appropriate actions can be taken.

Also shown is the countdown 706, which states, "time until next game begins :08" (meaning 8 seconds), and the number of seconds would decrease each second until it reaches zero, upon which on further bets can be placed on the forthcoming game and the dealer would begin dealing this game. Of course, no further bets can be taken once the dealer begins dealing because cards will start to be exposed which would indicate which bet is likely to win.

Figure 8:
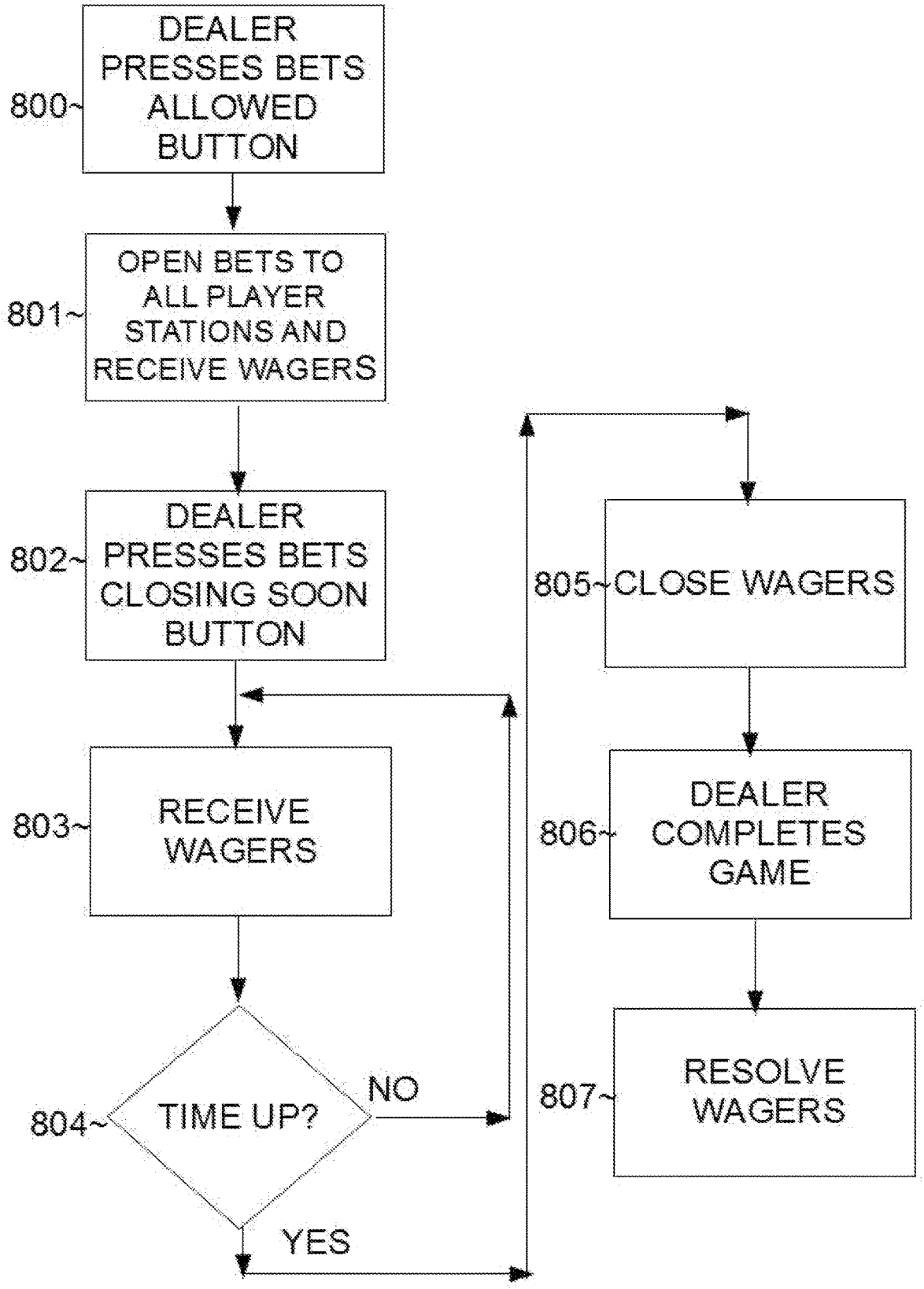
FIG. 8 is a flowchart illustrating an exemplary method of receiving wagers from a player on a networked gaming system with simultaneous dealers, according to an embodiment.

FIG. 8 is a flowchart illustrating an exemplary method of receiving wagers from a player on a networked gaming system with simultaneous dealers, according to an embodiment. FIG. 8 is performed individually for each table.

The method can begin with operation 800, in which the dealer presses the "bets allowed" button 701 for a particular table (e.g., table 1 or table 2). In other embodiments, a "bets allowed" button may not be necessary, as one of the outcome buttons also serves as the "new game" button and starts the countdown before the wagering for the next game at this particular table is closed and the game begins.

From operation 800, the method proceeds to operation 801, which opens bets to all player stations for the next game on the particular table. Players at each of the player stations can now place their wagers on the next game on the particular table on their player stations.

From operation 801, the method proceeds to operation 802, wherein the dealer at the particular table presses the bets closing soon button. This initiates a countdown (as described herein) for closing bets on the next game on the particular table.

The system can accept wagers from the player stations from the players for the next game on the particular table. Players may also simultaneously make wagers on other tables as well (besides the particular table) as long as wagering is open on these tables.

From operation 802, the method proceeds to operation 803, which continues to receive wagers from players at the player stations for the next game on the particular table.

From operation 803, the method proceeds to operation 804, which determines whether the time period is up for the particular table. This time period is identical to the time period in operation 603, which gives players a short time to decide and make their bets on the upcoming game on the particular table. Note that each table has its own respective time period where bets are open and they might not always run simultaneously (e.g., betting may be closed on one table while open on another). If the time is not up, then the method returns to operation 803 which continues accepting wagers.

If in operation 804, time is up, then the method proceeds to operation 805, which closes wagers for the particular table. If a player desired to place a wager on the upcoming game on the particular table but did not make the wager in time, it is too late and the player can watch the game on the player station but cannot wager on it.

From operation 805, the method proceeds to operation 806, wherein the entire game is dealt and completed on the particular table, according to the predetermined rules of the game being played. Each player can view the video of the game being dealt and completed on an output device on the player station. After the dealer has completed the game, the dealer will press the respective outcome button on the dealer's station.

From operation 806, the method proceeds to operation 807, wherein all wagers placed on the game in operation 806 are resolved. This is accomplished by the database/server 408 and/or other servers/computer on the network. Winning wagers are paid their respective payout (thus increasing the player's credit meter by a respective amount) while losing wagers are collected (decreasing the player's credit meter by a respective amount—unless the bet amounts were already deducted from the player's credit meter in which nothing further is deducted from the player's credit meter (or credit meter) but the player loses the chips that were displayed as the player's bet). Animations can be displayed on the betting areas at the player stations to make the display more enjoyable, for example, animated chips can be moved across the screen, sounds can be played, etc.

It is noted that each dealer station is not necessarily in sync with the other. In other words, the operations in FIG. 8 are performed for each table independent of each other table. So bets may be open on one table while they are closed on the other, or vice versa. Of course, bets can also be open and closed at the same time at both tables (dealer stations).

Figure 9:
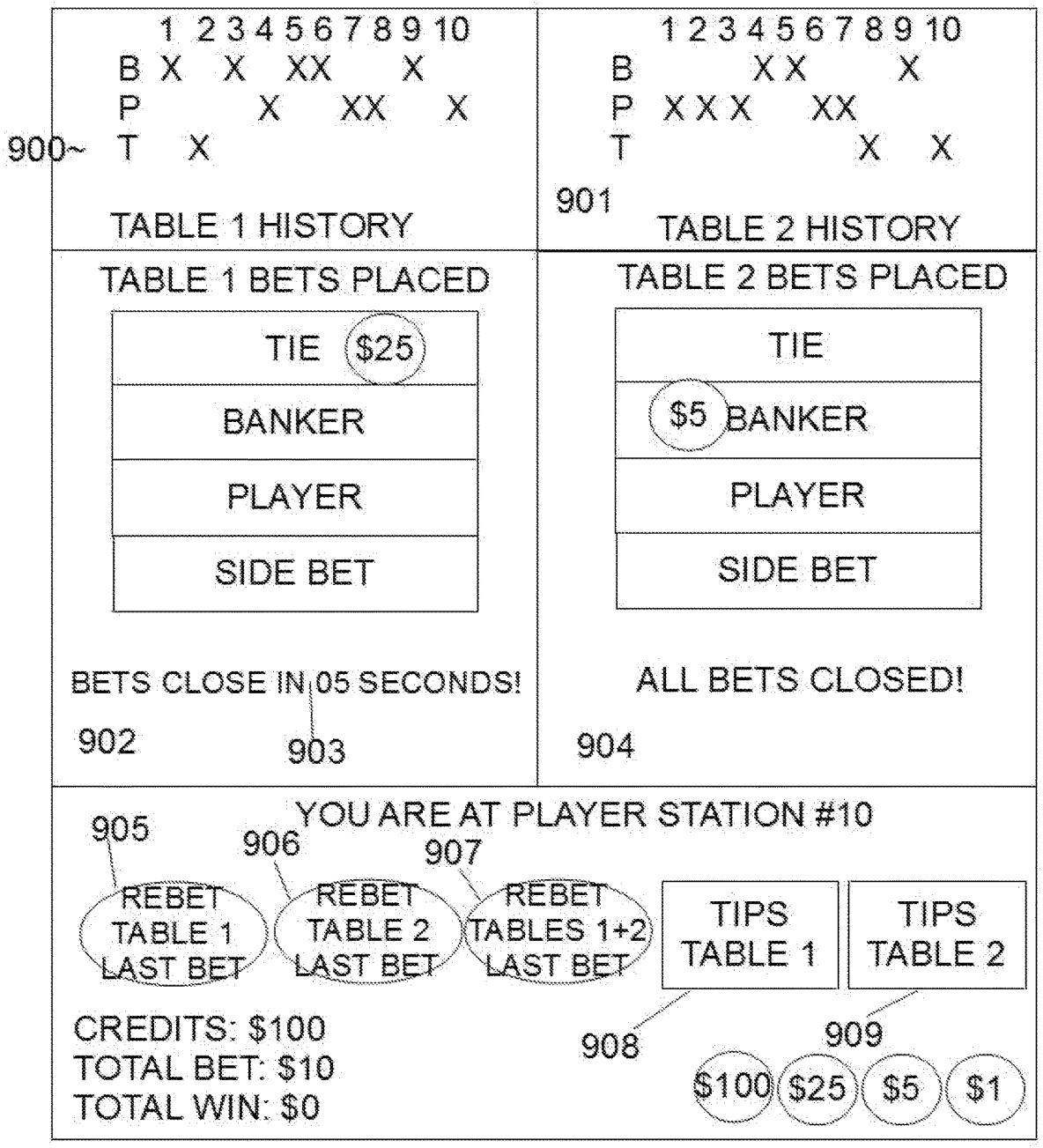
FIG. 9 is a drawing of a sample betting area, according to an embodiment.

FIG. 9 is a drawing of a sample betting area, according to an embodiment. Of course numerous arrangements and configurations can be used, and this illustrates merely one example.

The betting area is displayed on each of the player stations and allows the player to enter his/her wagers on either (or both) of the tables at the dealer stations. The betting area can use a touch-screen or other input device (e.g., keyboard, mouse, etc.) to allow the player to make their wagers. The player can first deposit money, tickets or vouchers from a bill validator (not pictured) to credit their machine.

A table 1 history (scorecard) display 900 displays the outcomes for the entire shoe history (history on this table since the shoe was last shuffled) on table 1 (e.g., game 1 is the first completed game outcome, game 10 is the last completed game outcome), wherein B represents a banker win, P represents a player win, and T represents a tie. A table 2 history display 901 displays the outcomes for the entire shoe history on table 2 in the same manner. The player station would automatically fill in these displays 900 901 so that the player can have an idea of which table may be "hot" or running a streak. Players are of course free to bet on either, or both, of the tables (or they can also decline to play both tables as well). At the end of each shoe both history displays would be automatically reset (cleared of all history).

A table 1 betting area 902 allows the player to place wagers on the bets the player wishes to make (e.g., the player can touch one of the denominational chips from the lower right onto one of the bets). Players can make bets in any amount (up to their amount of credits available) up to a predetermined table maximum. The table 1 betting area 902 shows that a player made a $25 wager on the tie. Only outcomes on the table 1 (the first dealer station) will determine which bets here win or lose. Also shown is a countdown readout 903 which shows that the bets on the table 1 betting area 902 will be closed in 5 more seconds (this countdown will count down each second until reaching zero, upon which no more bets will be allowed on the table 1 betting area 902 until a new game starts).

A table 2 betting area 904 operates in the same manner as the table 1 betting area 902 but bets placed therein are only controlled by outcomes on table 2 (the second dealer station). On table 2 bets have already closed. Thus, the player would not be able to make a further bet on the upcoming game on table 2 (or change his/her bet). The player has no control over when the bets are open and closed; this is a function of the dealer at each dealer station. All player stations would display the same status for each dealer station (bets open, bets closed, countdown timer, etc.) However, the status of different dealer stations may be different (e.g., one dealer station may have bets are open while another dealer station may have bets are closed).

A rebet table 1 last bet button 905, when pressed, will automatically make bets in the table 1 betting area 902 that match the bets made in the table 1 betting area the previous game on table 1. A rebet table 2 last bet button, when pressed, will automatically make bets in the table 2 betting area 904 that match the bets made in the table 2 betting area 904 the previous game on table 2. For example, if a player bets $6 on the player and $1 on the side bet in the table 2 betting area 904 and then the game on table 2 is over, if the player presses the rebet table 2 last bet button 906, then the computer would automatically make these same bets again in the table 2 betting area 904 (would put a $6 wager on the player and a $1 wager on the side bet in the table 2 betting area 904). Thus, this can save the player more time as the player would not have to individually remake all of the prior bets on a table.

A rebet tables 1+1 last bet button 907, when pressed, makes the wagers in both the table 1 betting area 902 and the table 2 betting area 904 that were made on the previous games for each of these tables. Thus, in the example illustrated in FIG. 9, after both games on table 1 and table 2 are over and the bets resolved (and subsequently removed from display), if the player simply presses the rebet tables 1+2 last bet button 907, the computer would automatically place a $25 wager on the tie in table 1 betting area 902 and a $5 wager on the banker in the table 2 betting area 904.

A tips table 1 box 908 allows the player to make tips to the first dealer at the first table at the first dealer station. The player can simply press (or drag) a chip of any denomination to the tips table 1 box 908 and the first dealer would receive the respective amount of the tip (which would also be deducted from the player's credit meter). Similarly, the tips table 2 box 909 allows the player to makes tips to the second dealer at the second table at the second dealer station. The dealers may be able to keep individually all of their tips or may have to pool them together and divide them, according to house rules. The dealers would not receive a physical chip but instead a total of the dealer's received tips would be maintained for each dealer. This amount can then be transferred to the respective dealer in numerous ways, for example the amount can automatically be added to the dealer's paycheck. Or a voucher can be printed at the dealer station (for the total amount of tips received while that dealer was dealing for the day) which the dealer can present to the casino cashier and receive cash. Or the casino can mail the dealer a check periodically for their (or their share) of the tips.

When the dealer receives a tip, the dealer can be notified of such on a display on the dealer station. For example a message can be presented to the dealer, "the player at player station #10 left you a $5 tip!" The dealer, upon reading this message, may look over at player station #10 and say thank you to the player at player station #10, wave in acknowledgement, etc. Of course, each player at each player station is free to decide when to tip, how much, and to which dealer. Typically, players like to tip dealers when they are winning.

Figure 10:
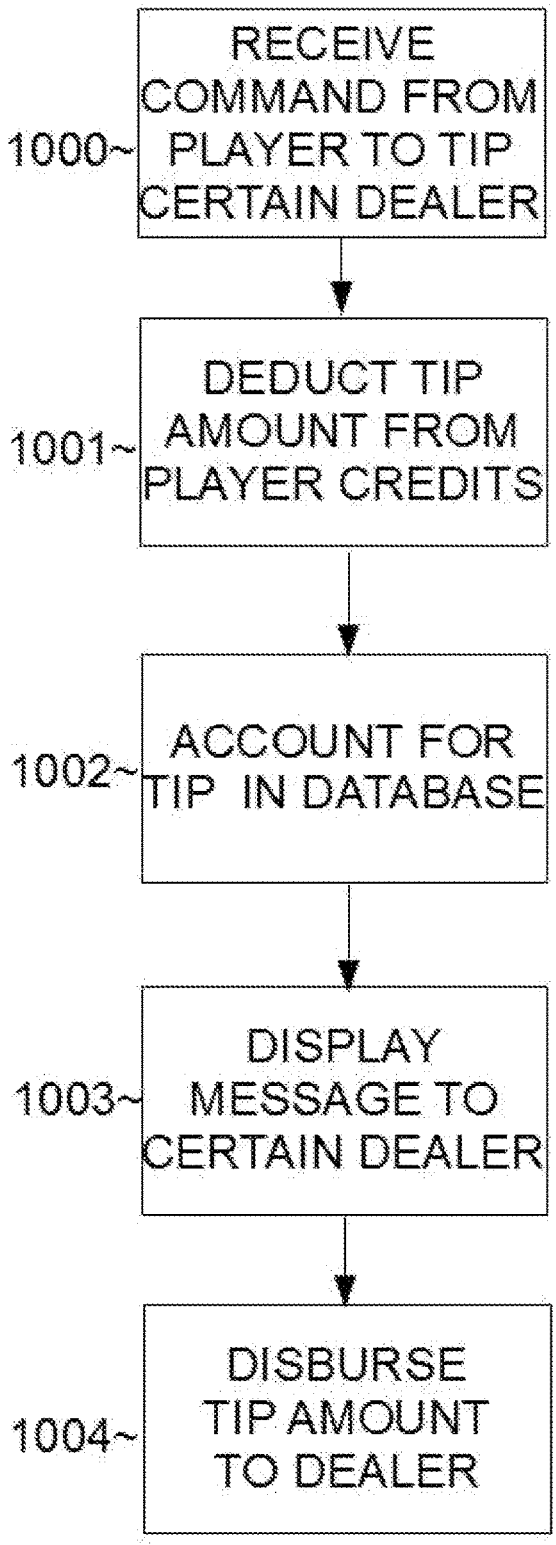
FIG. 10 is a flowchart illustrating an exemplary method of implementing an electronic tip, according to an embodiment.

FIG. 10 is a flowchart illustrating an exemplary method of implementing an electronic tip, according to an embodiment.

The method can begin with operation 1000, wherein the player indicates at the player station that he or she wishes to leave a tip for a certain dealer. The player can make this indication by pressing respective icons on a touch-screen at the player station (such as dragging a chip to a dealer 1 box (to give the tip to dealer 1) or a dealer 2 box (to give the tip to dealer 2) upon which the chip would disappear).

From operation 1000, the method proceeds to operation 1001, which deducts the tip amount from the player credits (the player credit meter). The player is giving this amount to the certain dealer so naturally the player's credit meter would be deducted by the same amount.

From operation 1001, the method proceeds to operation 1002, which accounts for the tip in the database/server. The database would track all tips placed by players and how much each dealer has earned in tips.

From operation 1002, the method proceeds to operation 1003 which displays a message to the certain dealer indicating that a tip was made in the amount to the certain dealer (and may also identify the player/player station making the tip). The message can be displayed on an output device on the dealer station that is visible by the dealer. The message can be, for example, "John at player station #5 left you a $3 tip."

From operation 1003, the method proceeds to operation 1004, wherein the tip amount would be disbursed to the certain dealer. This can be done in numerous ways, as described herein. In one embodiment, each dealer would have their own account on the system and tips paid to each dealer would automatically accrue in each dealer's account. Thus, dealers can keep their own individual tips left for them (thus dealers who may have been more "lucky" for their players may get more tips than "unlucky" dealers.) The dealer could withdraw their tips by requesting a check or cash at a casino cashier. If tips are pooled (where dealers do not keep their individual tips as described above), then the dealers would get their share of tips via check or on their paycheck.

Figure 11:
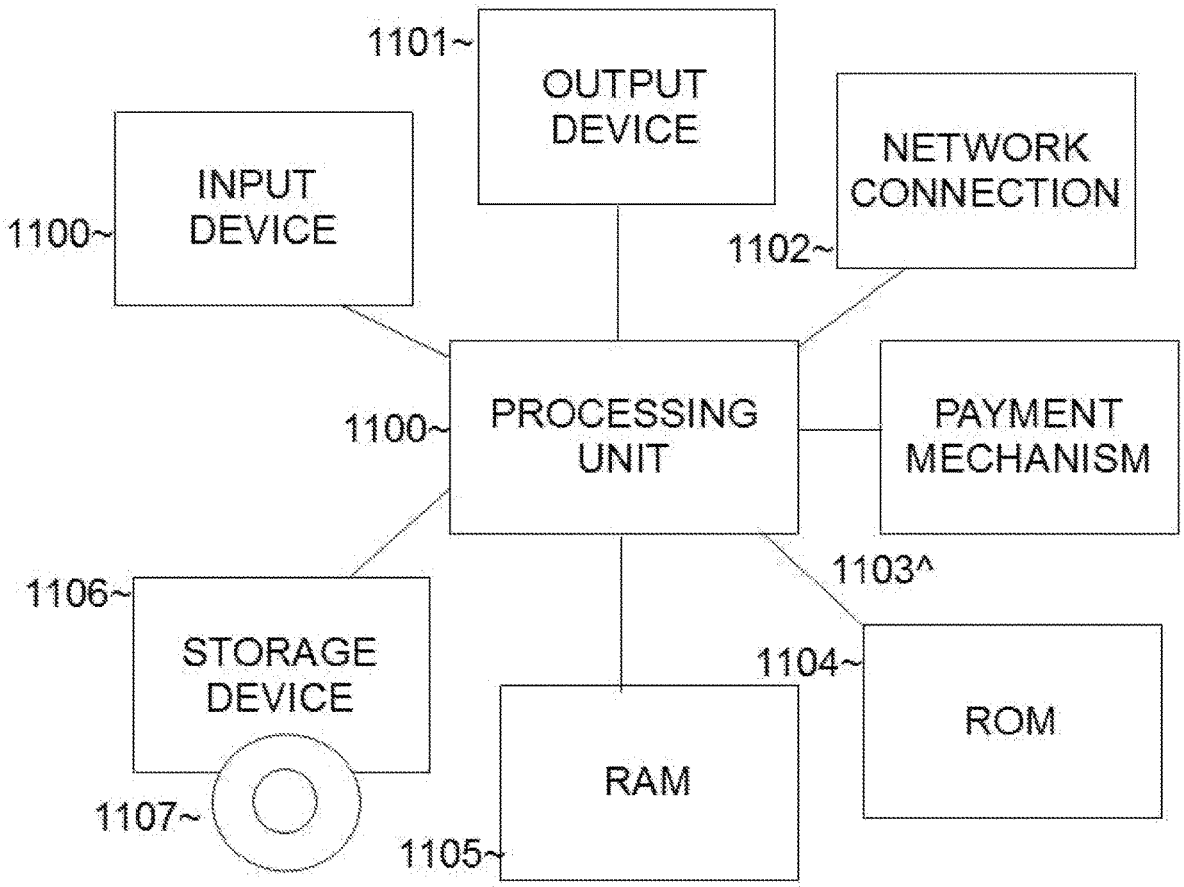
FIG. 11 is a block diagram illustrating hardware that can be used to implement the system described herein, according to an embodiment.

FIG. 11 is a block diagram illustrating hardware that can be used to implement the system described herein, according to an embodiment. All of the systems/methods described herein can be programmed and implemented using the hardware shown (or other structure). The hardware shown can be used to implement any of the components of the network, such as the dealer station, the player station, any databases and/or servers on the system (e.g., the database/server 408), any home computers on the network, etc. In fact, each component may contain one or more of this structure (e.g., the payment mechanism may in fact contain its own set of hardware with its own processing unit, etc.) All methods described herein can be controlled from a single set of hardware illustrating in FIG. 11 or it can be broken up into different (multiple) cooperating and communicating sets of hardware.

A processing unit 1100 can be a microprocessor and associated structure (e.g., bus, cache, clock, etc.) which is connected to an output device 1101 (e.g., LCD, CRT, speaker, etc.) and an input device 1100 (e.g., touch-screen, keyboard, mouse, buttons, etc.) Note that there can be more than one input device and/or output devices. The processing unit 1100 is also connected to a network connection 1102 which allows the processing unit 1100 to communicate on a computer communications network (e.g., LAN, WAN, Internet, wifi, etc.) The processing unit 1100 can (for example in the player station) also be connected to a payment mechanism 1103 which can accept and/or make payments to the player. For example, accepting payments can be done via a bill validator and/or a ticket validator (accepts cashless tickets/vouchers) which accepts the bill/ticket and credits the game with the respective amount of credits. Payment can also be accepted using electronic payments, such as a card (e.g., credit card, casino card, etc.) reader, etc. Payments can be made to the player in the form of cashless tickets/vouchers which can then be redeemed for cash at a casino cashier or a kiosk dedicated to dispensing cash in exchange for tickets. The processing unit can execute instructions to implement any of the methods described herein.

The processing unit 1100 can also be connected to a ROM 1104 (which can store instructions for the processing unit such as the operating system, etc.) and a RAM 1105. A storage device 1106 can be a nonvolatile storage device (e.g., CD-ROM drive, BLU-RAY drive, EPROM, hard disk drive, or any non-transitory storage medium.) which can read a compatible computer readable storage medium (e.g., CD-ROM, BLU-RAY disc, hard disk, etc.) Programs to implement any of the methods described herein can be stored on the computer readable storage medium 1107 as well as the ROM 1104, RAM 1105, server(s) (not pictured) or any other part of the system.

The games that are offered to the player stations can also be offered to players who are located at different geographic locations (outside of the casino where the player stations are located, inside and/or outside of the state where the player stations are located, etc.) In this manner, players who are located at other locations (for example at their home) can use their home computer (or cell phone, tablet, etc.) connected to the Internet to play and wager on the games offered in the same manner as if a player was playing the games directly at a player station as described herein.

Figure 12:
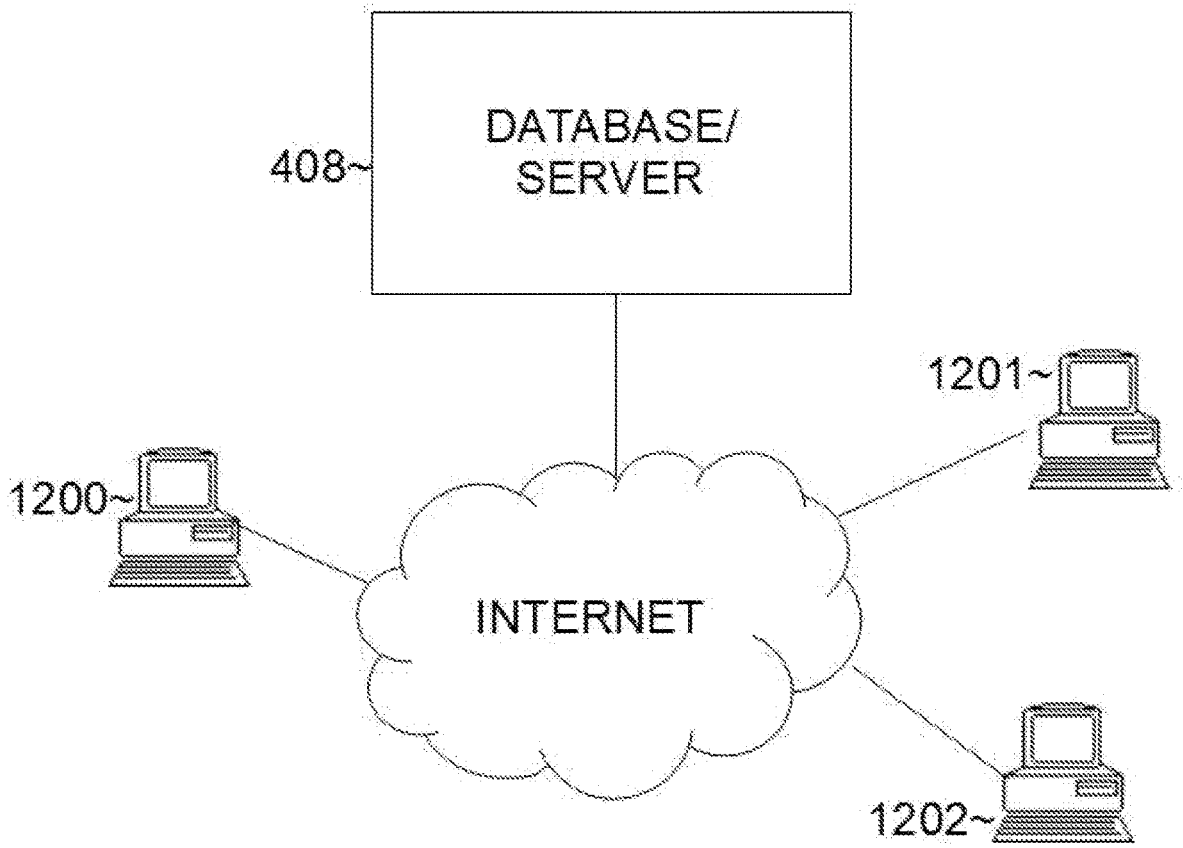
FIG. 12 is a block diagram illustrating a network that can be used to accommodate online players, according to an embodiment.

FIG. 12 is a block diagram illustrating a network that can be used to accommodate online players, according to an embodiment.

The database/server 408 as described herein can be connected to the Internet which can then interface with computers 1200, 1201, 1202 (these can also be portable devices such as cell phones, PDAs, tablets, etc.) The computers 1200, 1201, 1202 (and others) can be located at remote physical locations (such as remote players' homes or when they are on the go using their cell phones). Remote players who are using the computers 1200, 1201, 1202 can be presented with the same experience as players who are actually playing at the player stations as described herein and can view on their computer screen the same (or similar) output as illustrated (and described) in FIG. 5 (and other Figures). The remote players can wager for fun or real money on the baccarat game at one or both dealer stations in the same manner as the players who were actually on location where the physical player stations are located. The remote players can fund deposit funds in order to wager with these funds using a variety of methods, such as depositing via bank account, credit card, PAYPAL account, or any other electronic payment mechanism. The remote players can set up accounts with the database/server 408 where the funds are deposited into and tracked so that the player can leave the game and whatever funds the player has in his/her account would be retained by the database/sever 408 so the player can continue to wager with these funds (or requested a cashout). A player account can be set up online such as requested personal information about the player (e.g., name, login, password, email address, banking information, age verification information, etc.) A remote player can request a cashout online upon which the remaining funds can be paid to the remote player in cash using transfer methods such as electronic funds transfer (e.g., into the remote player's checking account), a check can be mailed to the remote player, an ATM card can be mailed to the remote player which allows the player to access funds which are transferred into an account upon cashout that the remote player can withdraw from at any ATM machine using the ATM card, or any other payment mechanism.

While the database/server 408 is described herein as accommodating the remote players, an addition server(s) connected to the system can be used to implement these operations as well and the database/server 408 is referred to herein for simplicity.

In this way, a remote player using a remote computer can access the system and play along with either or both of the dealer stations in the same manner as if the remote player was physically located at the casino (or other location) where the physical dealer stations and player stations are located. Thus, in addition to the number of players that can be accommodated at the physical player stations at a casino, additional players can be accommodated and enabled to wager on the games herein using the internet. Since the functionality available to an online player is the same as the functionality a player can use if playing at a physical player station, some players may prefer to stay home (which can be miles, one hundred miles or more, or even thousands of miles from the physical player stations located at the physical casino site) and play remotely as a remote player. The remote player using the computer is considered "off-site" since it is off the physical grounds (e.g., casino property) where the player stations and dealer stations are located. Of course a system such remote players would be subject to compliance with applicable laws regarding online wagering. Since the video (from either or both dealer stations) is broadcast live to the remote players at the computers 1200, 1201, 1202 (in the same manner as at the player stations), the remote players should typically be satisfied that there is no cheating or manipulating of the games by the casino. Any number of remote computers (each with its own respective remote player) can connect to the database/server 408 so that all such remote players can bet on the games simultaneously online.

The computers 1200, 1201, 1202 used by the remote players would have input mechanism(s) such as a touch screen, keyboard, mouse, buttons, voice recognition, etc., so that the respective remote player(s) can interact with the displayed screen which is then transmitted to the database/server 408 so that the wager's made by the remote players can be transmitted, recorded, and resolved by the database/server 408. Losing wagers are deducted from the remote player's account and winning wagers are paid to the player's account in the same manner as players who are playing using the player stations. All wagers placed remotely are subject to the same countdown and bets closed protocol as the wagers placed at the player stations so that remote players cannot place bets on individual games that have already taken place.

Thus, the system as described and referred to herein allows an unlimited number of players such as dozens or more (up to of course the number of players that can be accommodated physically) to place real time wagers on live games being transmitted live on video from a plurality of dealers (e.g., one, two, or more than two). The wagers can be resolved based on the outcomes of these games (broadcast to players live) and then new wagers can be accepted (for a subsequently dealt live game), all in real time. Wagering is similar in manner to playing at a traditional casino gaming table, however the live videocasting and networked terminals (that accept real time bets) as described herein that operate in real time allow many more players to wager on a game (typically a baccarat table can accommodate only a small number of players such as 7). Because the casino has an overall mathematical advantage, the more players that play on the game the more money the casino will make in theory.

In an embodiment, there can be more than two available dealer stations which are being used to deal games by live dealers simultaneously. In this embodiment, the player at each player station may be required to choose which two dealer stations (out of the more than two dealer stations) he/she picks to play at. The player may have to make this choice because there may be limited video display space at a player station to accommodate more than two simultaneous games. In another embodiment, the player can player more than two (e.g., three or more) simultaneous games at the same player station and the video output device will display all three or more outputs of the dealer stations (and accept wagers from all of these dealer stations).

Figure 13:
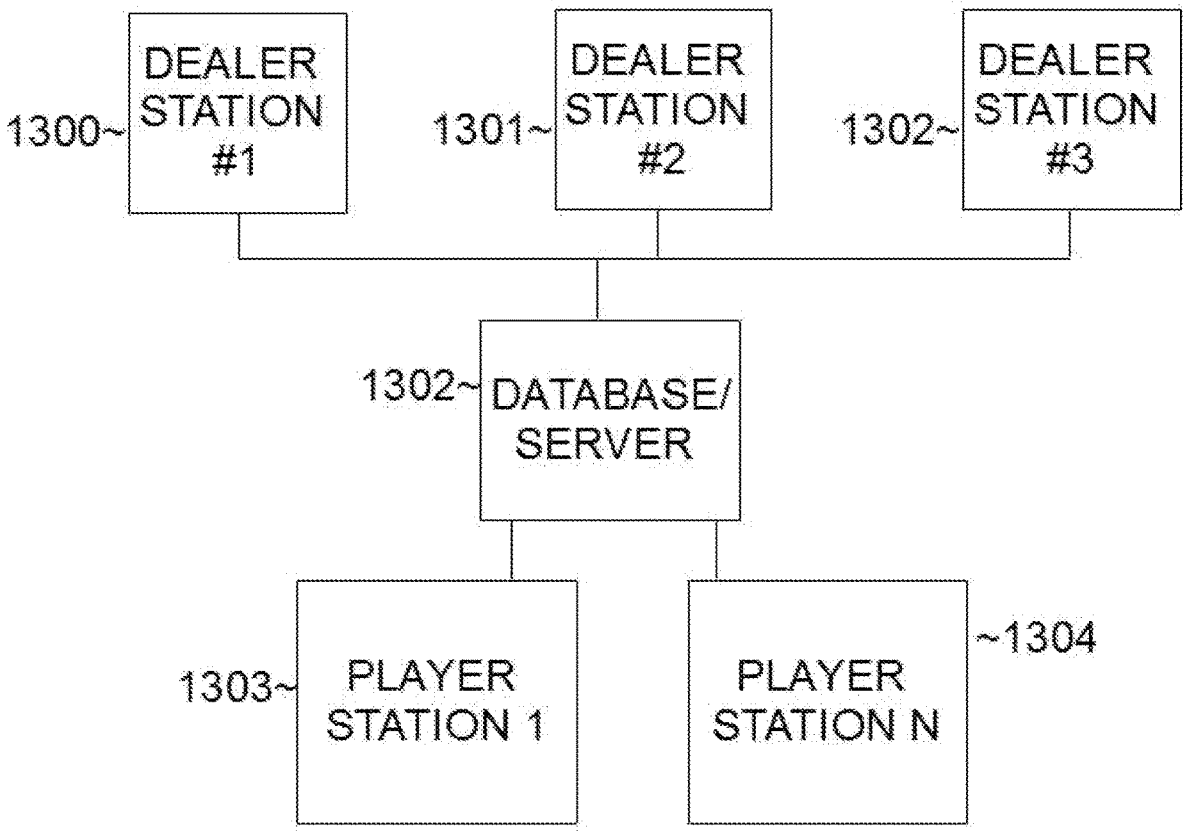
FIG. 13 is a block diagram illustrating dealer and player stations with more than two dealer stations, according to an embodiment.

FIG. 13 is a block diagram illustrating dealer and player stations with more than two dealer stations, according to an embodiment.

FIG. 13 is similar to FIG. 4 but shows more than two dealer stations. Additional dealer stations (more than two) can also be added to FIG. 13 which are all connected to the database/server 408/

In FIG. 13, there can be any number of player stations (from 1 to N, N can be any number up to 100 or more). The player stations 1303, 1304 are not required to be in the same physical location, for example, some can be at the same physical locations and some can be at different physical locations (e.g., different casinos, some player stations can be played on a personal computer at a player's home while other player stations can be at a physical casino, etc.) Similarly, all of the dealer stations (1300, 1301, 1302) do not necessarily have to be at the same physical location but some can also be at different physical locations (e.g., some can be at the same casino and some can be at a different casino). There can be any number of dealer stations that are all connect to the database/server 1302 (using a local or remote connection), such as 1 to 10 dealer stations (or more). The database/server 1302 (which can also be connected to the internet) is the same as the database/server 408 from FIG. 4, and similarly the player stations and dealer stations in FIG. 13 operate as described in FIG. 4 and as otherwise described in this document.

Figure 14:
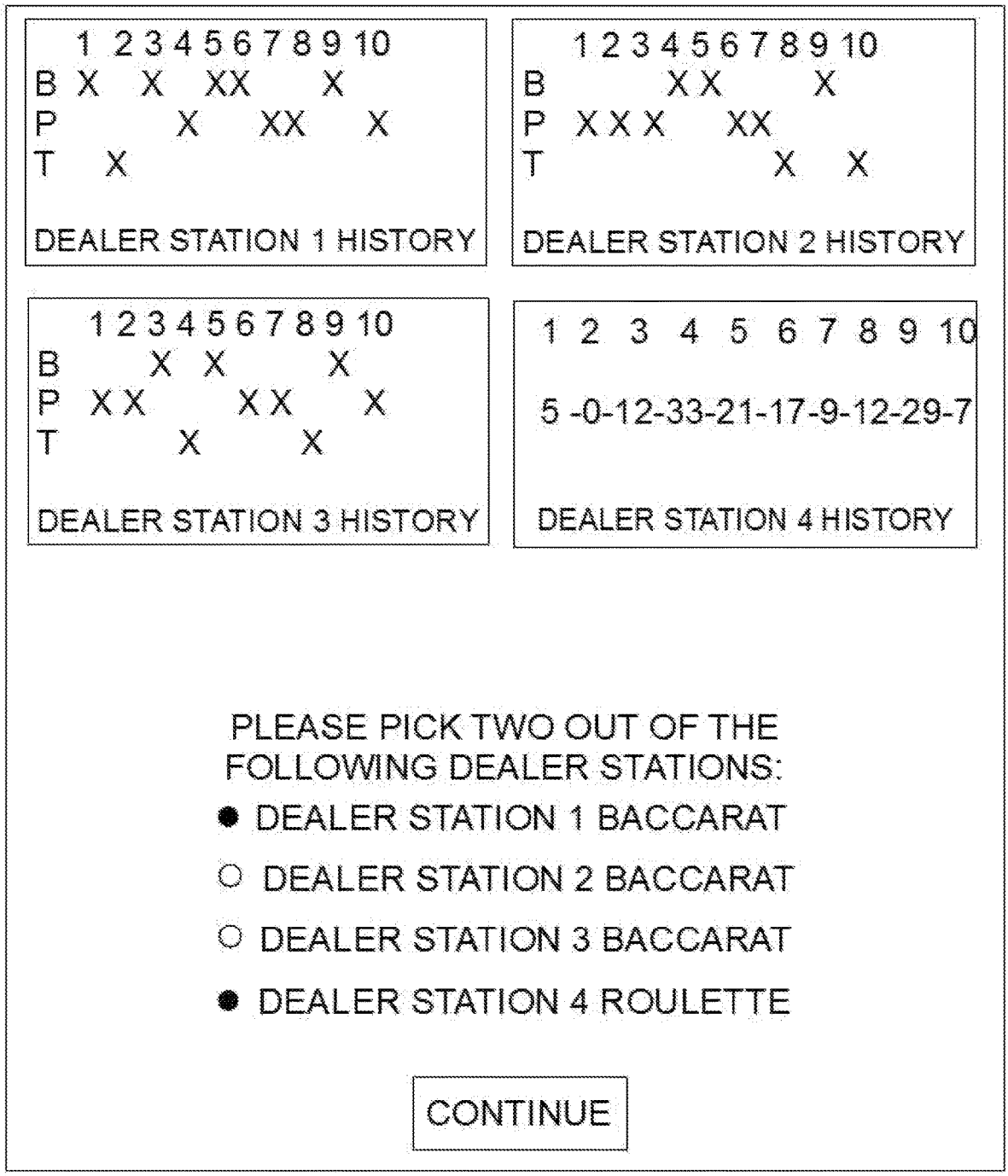
FIG. 14 is a dealer station selection screen, according to an embodiment.

FIG. 14 is a dealer station selection screen, according to an embodiment.

In this embodiment there are four available dealer stations which are currently playing live games in which the player can bet on (as described herein). The player can choose two out of the four dealer stations. The history from all four dealer stations can be displayed so that the player can use this information in picking which dealer stations to select. The payer can use the radio buttons (or other GUI mechanism) to indicate the player's selections of the two dealer stations to bet on. Note that not all of the games on all of the available dealer stations are the same, for example dealer station 4 shows roulette while the other stations are dealing baccarat. Note that the dealer station 4 history shows a history of the last 10 roulette spins. Note that any combination of game types can be offered on the available dealer stations, such as baccarat, blackjack, roulette, craps, etc.

Note that a different game type is an entirely different game (e.g., blackjack, craps, etc.) with different rules (and usually played with different equipment). The player selects two of the available dealer stations using the radio buttons that will be active (that the player can view and bet on) on the player's player station. Note that in this example two active dealer stations can be selected out of an available four, although any other number of active dealer stations (the ones that will be broadcast live to the player and the player can bet on in real time) can be used and any number of available dealer stations can be used. In this example the player has selected dealer stations 1 and 4. Note that the dealer at dealer station 4 is dealing a roulette game and would have the necessary equipment (roulette table, etc.) which will be captured on the live video feed from dealer station number 4. However, the other mechanisms for the dealer will remain the same as described herein for baccarat (e.g., the bets allowed button, bets closing button, result buttons, etc.) Dealer station 4 would have result buttons for each of the possible outcomes in roulette. Typically, there are 38 possible outcomes on a roulette wheel thus there would be 38 buttons each with a different roulette number on it (e.g., 0-36 plus 00).

Figure 15:
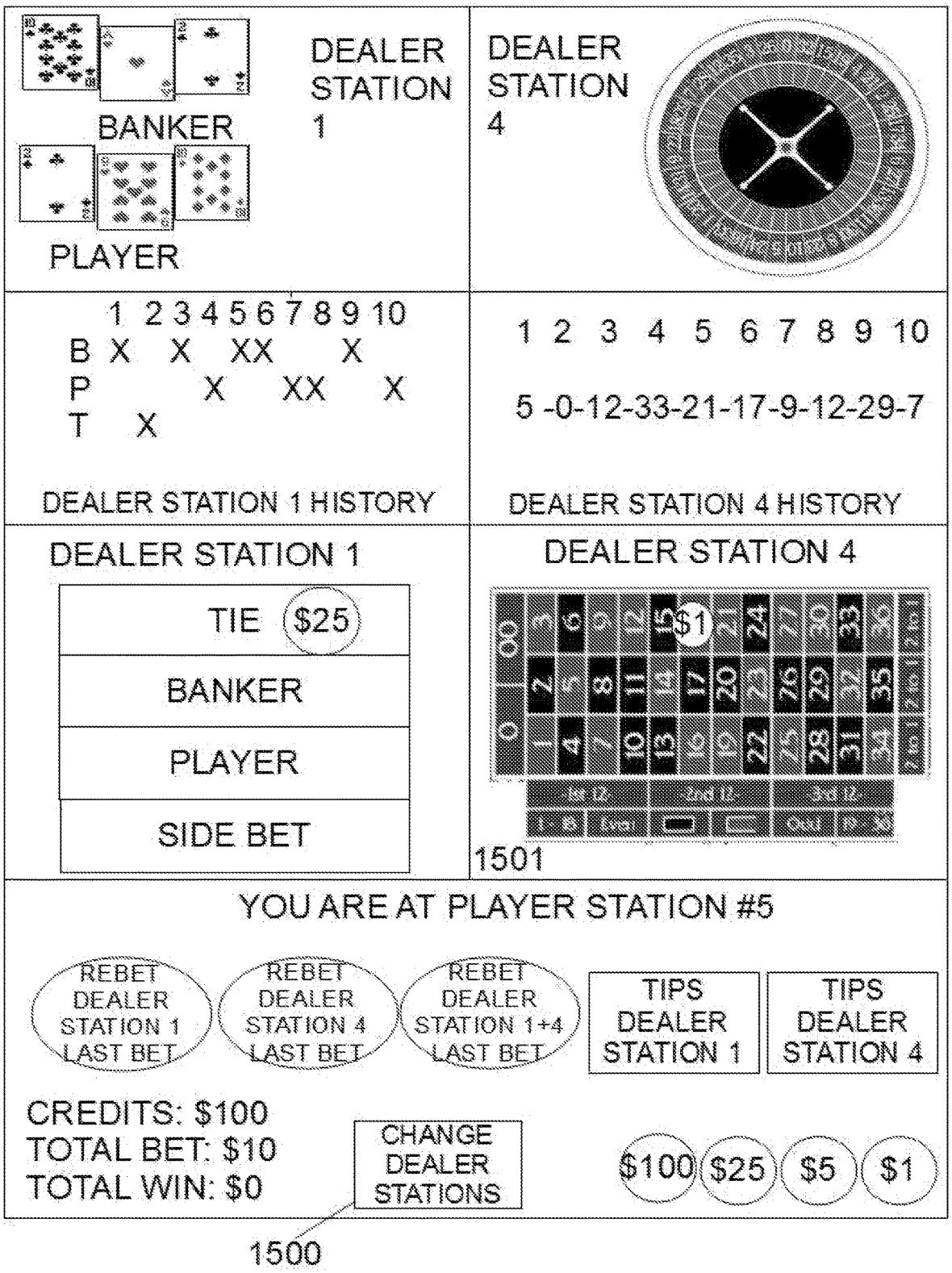
FIG. 15 is a drawing of sample output on a player station, according to an embodiment.

FIG. 15 is a drawing of sample output on a player station, according to an embodiment. Both of the dealer stations selected from FIG. 14 are now shown on the output screen at the player station.

Note that dealer station 1 is shown which shows the activity from dealer station 1 and dealer station 4 is shown which shows the activity from dealer station 4. The roulette wheel shown on the upper right is the video feed from dealer station 4 which shows the live video from the dealer station 4 of the wheel spinning. Typically, the live videos from all dealer stations are not interrupted (the player sees all action from the game beginning to the game end to the start of the next game and so on). The cards on the upper left are the live video from the dealer station 1.

The betting area for dealer station 4 is different from that of dealer station 1. This is because the bets for a roulette game are different than the possible bets for baccarat, and thus a roulette layout 1501 is shown which allows the player to place bets on the outcomes of dealer station 4. The player can place bets simultaneously on dealer station 1 and dealer station 4 as described herein.

A change dealer stations button 1500 would bring up the screen illustrated in FIG. 14 so that the player can change the current active dealer stations. The player is free at any time to change the current active dealer stations. For each active dealer station, of course the live video feed for that station is displayed along with the appropriate betting areas and the history for that dealer station.

In a further embodiment, the methods and systems described herein can also be applied to tournament play. A tournament is where players are given chips that are not redeemable for cash (unlike the other embodiments described herein wherein chips are directly redeemable for cash) and the players in the tournament compete with each other to see who can win the most chips before the tournament ends. The tournament can end within a predetermined period of time (e.g., 30 minutes) or after a predetermined number of hands have been played (e.g., 15 baccarat hands). Players are free to bet as much as they want in a tournament. When the tournament ends, the player with the most chips wins first place (and wins a prize for first place). Optionally (according to the house rules), prizes can be awarded for second place and third place. Prizes would typically be predetermined (e.g., $1000 for first place, $500 for second place, etc.) At the end of the tournament, the chips the players in the tournament are left with (from the tournament play) are not redeemable for cash. Thus, what matters is the place each player comes in which determines each player's award.

Tournaments can be offered by the casino and players at player stations can choose whether to play in a tournament or play in a standard wagering made (making real bets for real cash as described herein). Players can be playing in a tournament at the same time that other players can be playing in the standard wagering made. Typically, players playing in a tournament must all start at the same time.

In this way, the games being dealt at the dealer stations can be applied both to standard casino play (making cash bets which win cash) or tournament play.

Figure 16:
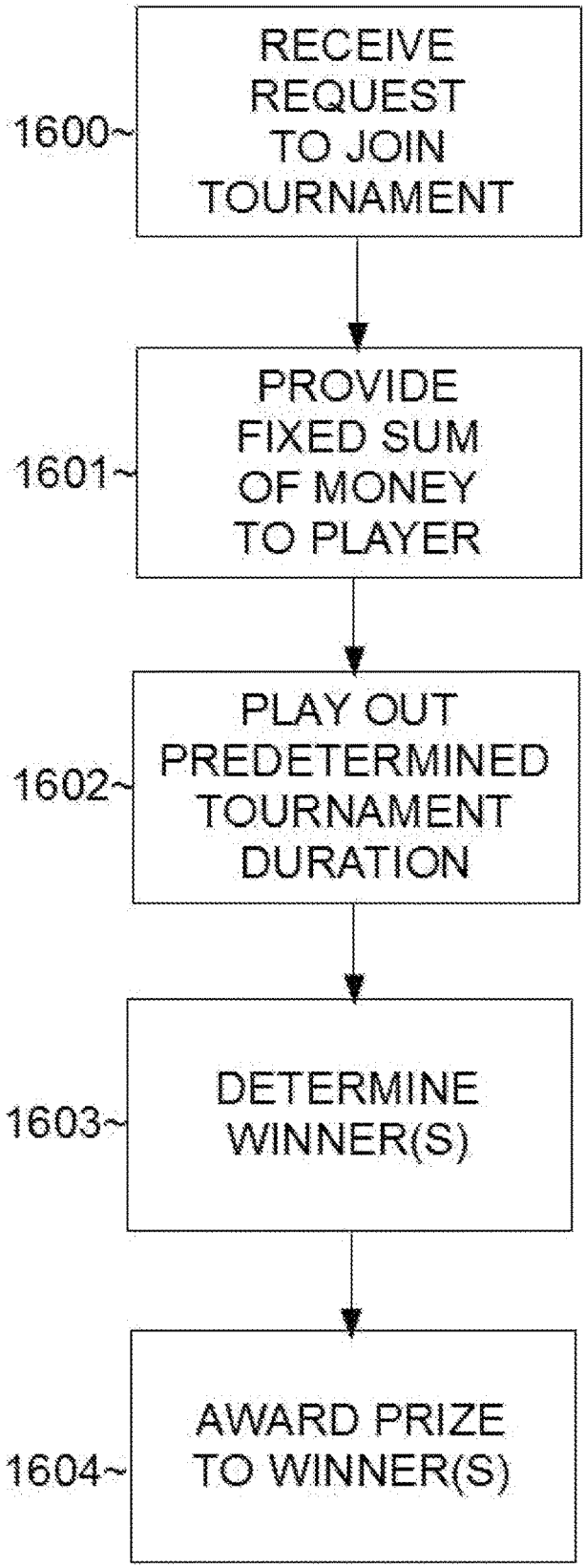
FIG. 16 is a flowchart illustrating an exemplary method of implementing a tournament, according to an embodiment.

FIG. 16 is a flowchart illustrating an exemplary method of implementing a tournament, according to an embodiment.

In operation 1600, each player can request to join a tournament. For example, a casino may advertise that a baccarat tournament may begin at 10:00 pm on a particular date. To enter a tournament may require a "buy in", that is, a player may be required to pay a cash amount (e.g., $100) in order to enter the tournament (the cash amount can be set by the house/casino). The buy in amount can be deducted from each player's credits on the player's player station. Tournaments may (or may not) have limits in the amount of players that can play them (e.g., limited to a maximum of 50 players) and the server would enforce these limits.

From operation 1600, the method proceeds to operation 1601, which provides a fixed sum of money to each player in tournament. For example, each player would get $1,000 in tournament chips (not redeemable for cash) to play in the tournament. These tournament (non-cash value) chips would be provided on the player station and wagered with in the same manner as regular cash-value chips.

From operation 1601, the method proceeds to operation 1602 wherein the tournament proceeds and continues for the entire tournament duration. The tournament can last for a predetermined number of hands (e.g., 10 hands) wherein all of the tournament players would play using the same dealer station and play the same hands (for example all players in the tournament must play the same 10 hands at the same dealer station and then the tournament ends), or in an alternative embodiment the tournament players would not be required to player the same hands and/or play at the same dealer station. Alternatively, the tournament can last for a predetermined number of times (e.g., 20 minutes) where the tournament players would either be: 1) required to all play at the same dealer station; or 2) not required to play at the same dealer station.

During the tournament, in one embodiment each player can be presented with a display as to how many chips each other player currently has (their current cash value) which can help each player plan their strategy as to how much they should bet. In another embodiment, the players would not be presented with the display as to how many chips each other player currently has.

In one embodiment, players in a tournament would only be allowed to play a particular game (e.g., baccarat). In another embodiment, players in a tournament would be allowed to mix games and play whichever games they wish to play (e.g., baccarat, roulette, craps, etc.) by using the dealer station selection screen (illustrated in FIG. 14) to select which dealer stations to make active.

During the tournament, the game-flow is the same as was described herein for regular (non-tournament) game-play (cash wagers). The dealers would still follow the protocol illustrated in FIG. 8 (and all other figures as well). In this manner, whether players at their player station is playing in a tournament or not does not affect the flow of the game, and thus tournament and non-tournament players can all play at (and virtually share) the same dealer station(s). In one embodiment, a player may be able to play in a tournament (which uses non-cash value chips) and simultaneously make real cash wagers (at the same dealer station as the tournament play or different dealer station(s)).

Once the tournament has reached its duration, the method proceeds to operation 1603 which determines the winners of the tournament. This can be done by first looking at the house rules of the tournament (which are stored by the server and is administered by the server) to see how many winners the tournament would have. The tournament rules can be configured by the house/casino using the admin station 409 (or other input device). If there are to be X winners, then the top X players in terms of the value of their tournament chips after the tournament is over would be the winners (in the order of the amount of their chips). Thus, for example, the player with the highest amount of tournament chips would come in first place (and win first prize), the player with the next-highest amount of tournament chips would come in second place (and win second prize), etc.

Typically, the total amount of prizes would be less than the total amount of the buy-ins so that the house would make a profit. For example, if a buy-in for a tournament was $10 and there were 50 players in the tournament, and first prize was $300 and second prize was $100, then the house would make a profit of $100.

From operation 1603, the method proceeds to operation 1604, which would award the respective prizes to the winner(s). The prize can be awarded simply by adding the cash value of the respective prize to each winner's credit meter (which shows credits which can be directly redeemable for cash).

In this manner, the game being dealt at one or more dealer station(s) can be played at both by standard wagering players as well as tournament players. Different player stations could be in different modes, e.g., if there are 10 player stations, then player stations 1, 3, 5-8 and 10 could be in standard mode and player stations 2, 4 and 9 would be playing in tournament mode.

In a further embodiment, instead of baccarat, a blackjack game can be implemented which can be played by numerous simultaneous players using any of the methods/systems/embodiments described herein. Implementing blackjack presents numerous challenges over baccarat because in baccarat there are no player actions to take (other than selecting the bet), while in blackjack the player can choose to play a certain way (hit, stand, double, split, etc.) However, the same cards that are dealt by the dealer at each table are used to deal to each player regardless of their strategy.

The casino game of blackjack is well known, for example see U.S. Patent publication 2003/0155715 which is incorporated by reference herein in its entirety.

Figure 17:
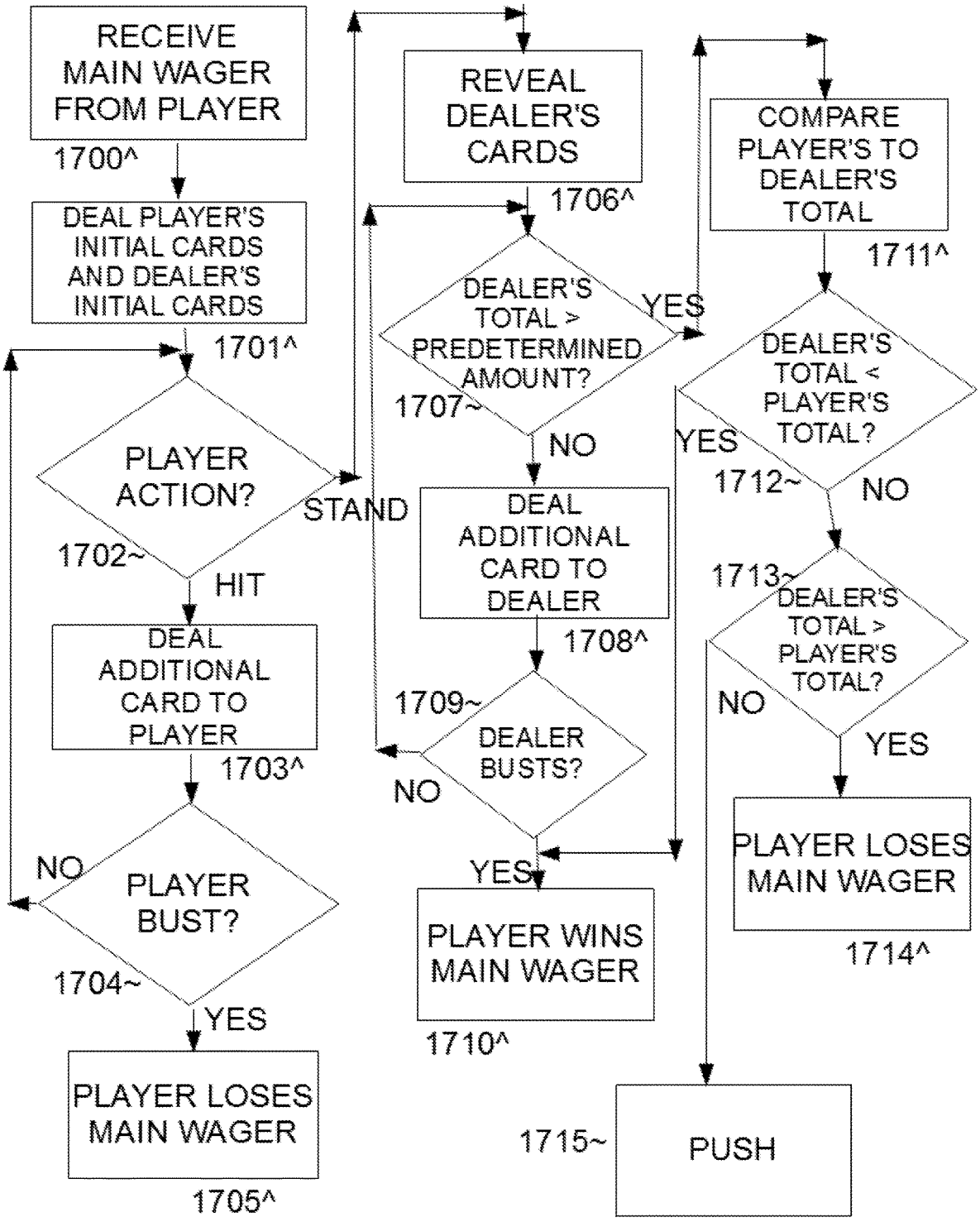
FIG. 17 is a flowchart illustrating a method of implementing the known game of blackjack.

FIG. 17 is a flowchart illustrating a method of implementing the known game of blackjack.

Points totals are computed by adding the standard rank value of each card, with face valued cards (tens, jacks, queens, kings) being given a value of 10, and aces being given a value of 1 or 11, whichever results in a better hand. A soft point total is where at least one ace is given the value of 11. A hard point total is a hand with all aces counting as 1.

In operation 1700, the player makes a main wager by placing chips on a virtual table (using a touch-screen, mouse, etc.). Then, in operation 1701, the dealer deals two initial cards to each player (typically face down) and two initial cards to the dealer, typically one face down ("hole-card"), and one face up (the "up-card"). Then in operation 1702, the player can decide whether to hit, stand, double, or split (and the player takes such action by using a touch-screen, mouse, etc.). If the player decides to hit, then the method proceeds to operation 1703, which deals an additional card to a player. If a determination 1704 determines that the player has busted (the player's hard point total is over 21), then the player loses the game and thus loses the main wager in operation 1705, which ends the game. If the determination 1704 determines that the player has not busted, then the method returns to operation 1702, where the player can make another decision whether to hit or stand. In operation 1702, the player can also double (not pictured) by place an additional wager in value up to the main wager (but not greater), but the player is limited to drawing only one additional card (in operation 1703) before the player must subsequently stand (if the one additional card did not bust the player).

If the player stands and has not busted out (either stands on his or her initial two cards or draws cards but has a point total under 22 and then stands), then the method proceeds to operation 1706, which reveals all dealer's cards (e.g., turns the hole-card face up) and which then plays out the dealer's hand according to predetermined rules. If in operation 1707 the dealer's total is greater than a predetermined amount (typically 17), then the dealer stands (proceeds to operation 1711). In operation 1707, if the dealer's total is not greater than the predetermined amount, the method proceeds to operation 1708 which deals an additional card to the dealer. If it is then determined in operation 1709 that the dealer has not busted (the dealer busting meaning that the dealer has a point total over 21 with all aces in the dealer's hand counting as 1), the method returns to operation 1707. If the dealer has busted (the dealer has a point total of over 21 with all aces in the dealer's hand counting as 1), then the player wins the game and the main wager (typically paid a winning payout at even money) in operation 1710 (this assumes the player has not also busted; if the player has already busted then the player would have lost in operation 1705).

In operation 1711, both the player and the dealer have played out their hand and neither have busted. Thus, their respective point totals (adding the numerical values of each card in the hand) are compared. If the dealer's point total is determined in operation 1712 to be lower than the player's point total, then the player wins the game and the main wager in operation 1710. If the dealer's point total is determined in operation 1712 to not be lower than the player's point total, then the method proceeds to operation 1713. If in operation 1713 the dealer's point total is determined to be greater than the player's point total, then the player loses the game and the main wager in operation 1714. If the player's point total ties the dealer's point total, then that results in a "push" in operation 1715 in which the player doesn't win or lose the main wager (the player breaks even on the main wager).

If a player is initially dealt two identically ranked cards in operation 1701 then players can also split in operation 1702 by placing an additional split wager equal in value to the main wager, and the player's two initial cards are separated and the dealer deals an additional card on each. The player then plays out each of the two separate hands, each starting at operation 1702. Depending on house rules, players may or may not be allowed to resplit cards.

In an embodiment, players at player stations are presented with a blackjack game they can wager on, using the same methods/systems/embodiments described herein. The blackjack game is dealt at a dealer station and the cards dealt therein can be applied to a plurality of players at player stations. Different players at player stations can play the same initial hand dealt by the dealer as they wish (hit, stand, double, split) and so even though the cards dealt from the dealer station are the same, how they are applied can vary from player to player. If (for a game dealt on a dealer station) two different players (at different player stations) follow the same strategy, then the results will be identical for those two players. However, if the two different players follow different strategies (e.g., one player stands while one player hits) then their results can be different (e.g., one player can win while one player can lose). After the dealer's hand and the player's hand are both dealt, then additional cards are dealt into a hit box and applied accordingly to each player's game based on decisions taken in that game. After each game is completed, the wagers can be resolved (e.g., winning wagers paid, losing wagers not paid). All methods/systems/embodiments described herein (including those used in the baccarat embodiment) can be applied to the blackjack embodiment/game as well.

Figure 18:
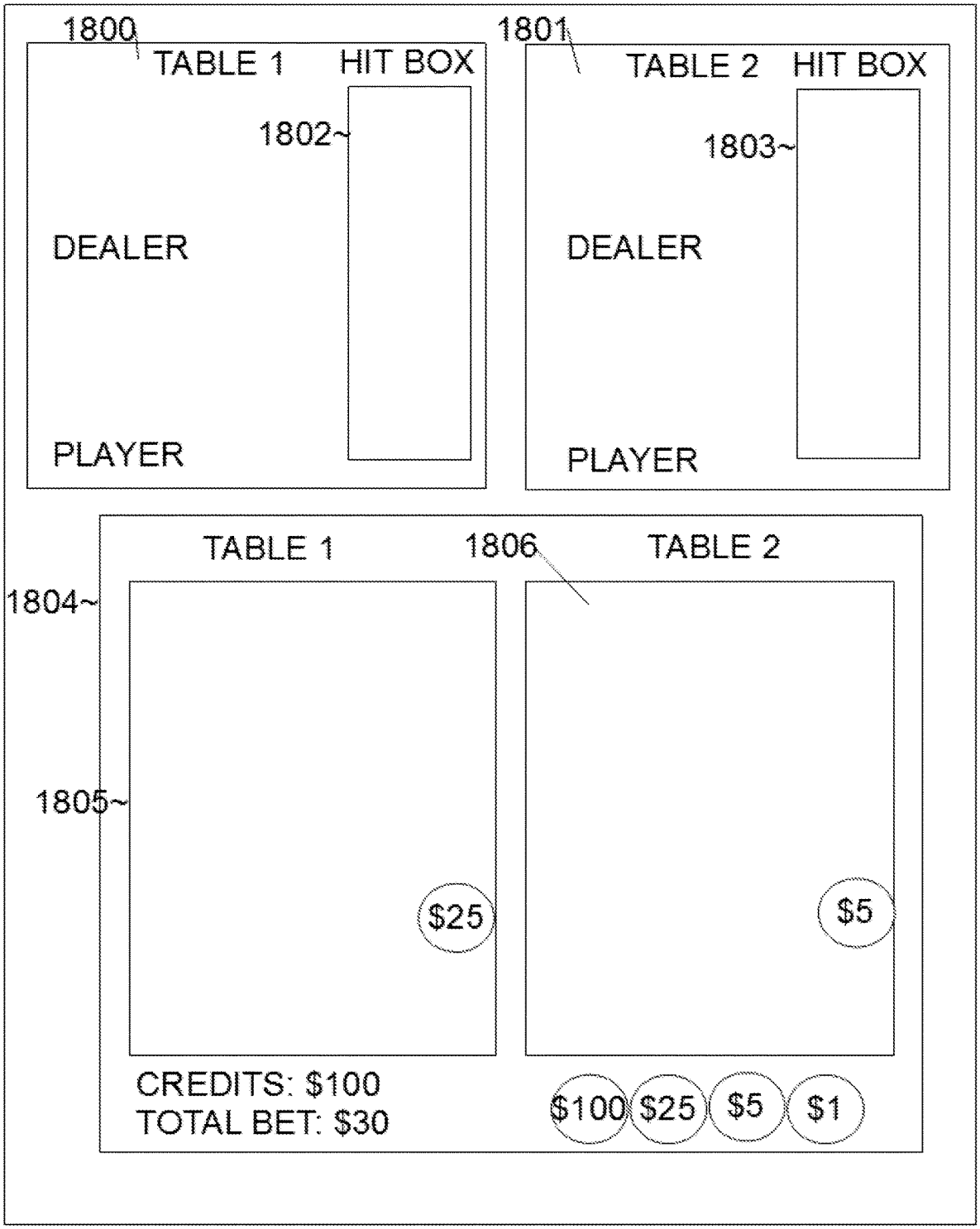
FIG. 18 is a drawing illustrating video outputs on a player station at the start of a blackjack game, according to an embodiment.

FIG. 18 is a drawing illustrating video outputs on a player station at the start of a blackjack game, according to an embodiment. Note that FIGS. 18-25 all take place in sequence (i.e., each successive figure happens after the previous figure).

A player is at the player's player station. The player station has numerous video displays. The video displays can be all displayed as windows on a single output device or can exist as separate output device(s).

A table 1 video display 1800 shows live video captured and broadcast simultaneously from table 1. A table 1 hit box 1802 is an area on table 1 where additional cards (after the initial player's two cards and the initial dealer's two cards) dealt are placed. A table 2 video display 1801 shows live video captured and broadcast simultaneously from table 2. A table 2 hit box 1803 is an area on table 2 where additional cards (after the initial player's two cards and the initial dealer's two cards) dealt are placed. The video shown in the table 1 video display 1800 and the table 2 video display 1801 is live video that is not computer generated. Table 1 is at a first dealer station (as described herein) and table 2 is a separate second dealer station (as described herein), each dealer station as a respective video camera (as described herein) so that the respective video can be broadcast and displayed simultaneously on the table 1 video display 1800 and the table 2 video display 1801.

A betting screen 1804 allows the player at this station to bet on the game being played at table 1 and the game being played at table 2. A table 1 betting area 1805 allows the player to place bets and take actions for the game being played at table 1. A table 2 betting area 1806 allows the player to place bets and take actions for the game being played at table 2.

In this example the player has placed a $25 wager on the game to be played at table 1 (the first game) and also placed a $5 wager on the game to be played at table 2 (the second game). Of course, the player is free to bet however much the player wishes on each game (but of course not more the player's own credit total). Before the player placed both wagers (totaling $30) the player's credits would have been $130.

Figure 19:
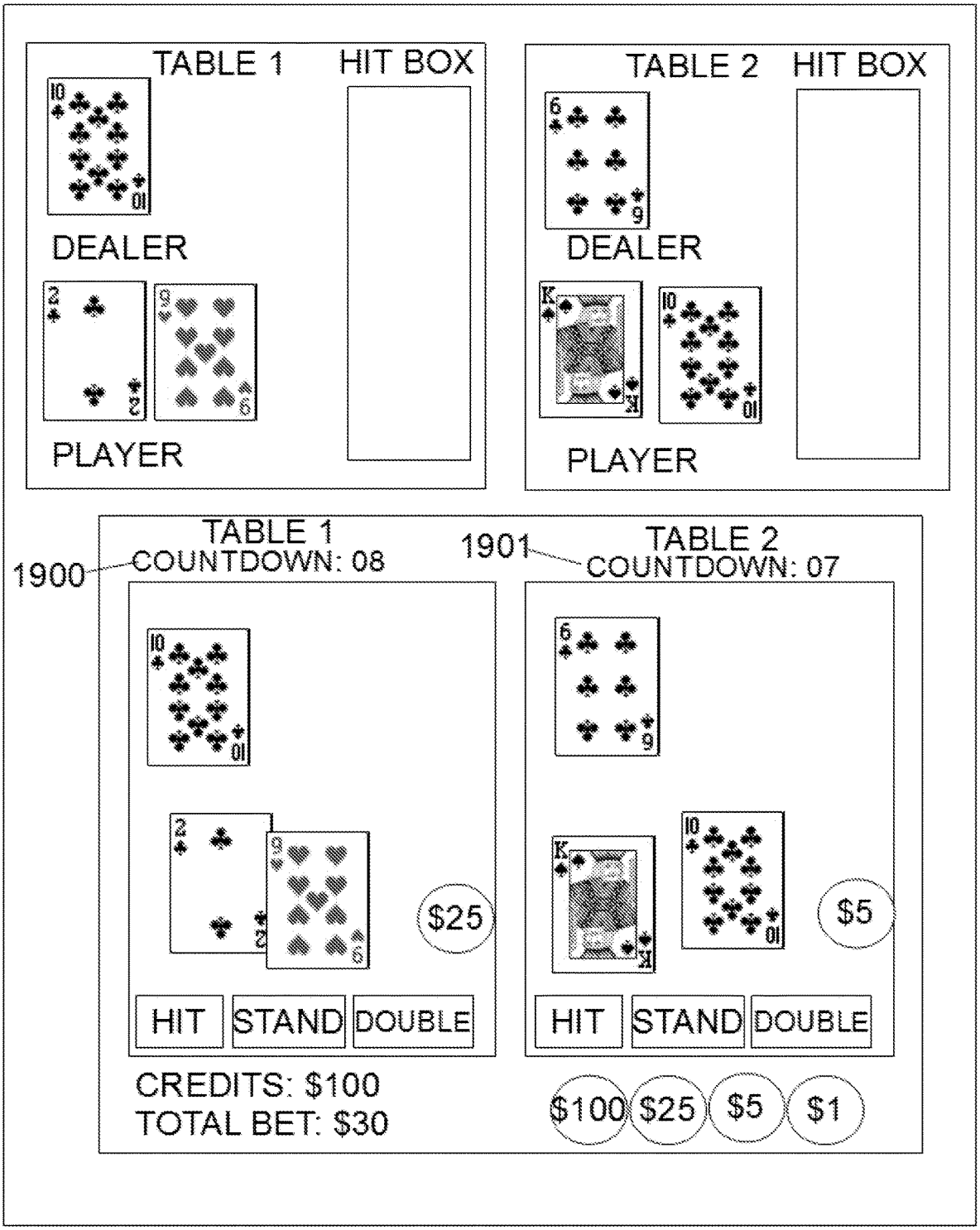
FIG. 19 is a drawing illustrating video outputs on a player on a player station at a second point in time, according to an embodiment.

FIG. 19 is a drawing illustrating video outputs on a player on a player station at a second point in time, according to an embodiment.

The dealer at the first dealer station (table 1) deals the initial dealer's hand (one up-card) and the initial player's hand (two cards). The raw video from table 1 is shown in the table 1 video display. The dealer at the second dealer station (table 2) deals the initial dealer's hand (one up-card) and the initial player's hand (two cards). The raw video from table 2 is shown in the table 2 video display. Note that in this example, the "European hole card rule" for blackjack is being implemented. In this embodiment, no dealer's hole-card (which would typically be dealt face down) is initially dealt. After the player has finished playing out his/her hand, then the dealer's second card (which could be considered the dealer's hole-card) and any additional dealer's cards would be dealt. The alternative to the European hole card rule is the American hole card rule which is when the dealer's second card is initially dealt face-down (when the dealer's first card is dealt face-up). Mathematically, it typically does not matter whether the American hole card rule or the European hold card rule is employed. The game described herein can be implemented with either hole card rule. In the example that follows the European hole card rule is employed. If the American hole card was is used, then the dealer's hole-card should not be revealed until all players have completed playing out their hand (so that a "cheating player" cannot communicate with other players to find out the value of the dealer's hole-card before the cheating player decides on his/her action to take).

Note that the display in the table 1 betting area (the same area as 1805 from FIG. 18) is all computer generated. The cards displayed are all computer generated using computer generated images and are not from the live video shown in the table 1 video display. The cards are made known to the system (e.g., the database/server) because the faces of each card are bar coded so that then each card is dealt out of a shoe (or shuffler) the system can automatically scan the barcode (or other electronic marker) so the system knows which cards are coming out. For example, the player station knows that the dealer's card is the 10-clubs and the player's cards are two-clubs/nine-hearts. The player station runs software that electronically generates in the table 1 betting area and animates these cards (they can be animated across the table 1 betting area). For example, note that the cards in the table 1 betting area are positioned differently than the cards in the table 1 video display. This is because while the cards in the table 1 video display are shown in actual live video and depict the cards as they exist in real life, the cards in the table 1 betting area are computer generated and thus can be in different positions. The cards in the table 2 betting area are also similarly all computer generated using the actual values from table 2 at the second dealer station (which are identified to the system from barcodes or other identifiers on the cards). The live video in the table 1 video display and the table 2 video display are shown to the player at the player station so that the player can verify that the cards displayed in the betting screen (table 1 betting area and table 2 betting area) are really the cards that were dealt at the physical dealer stations (table 1 at the first dealer station and table 2 at the second dealer station).

A first countdown timer 1900 shows the amount of time (in seconds) the player has to take to take action (e.g., hit, stand, double) for table 1 in the table 1 betting area. A second countdown timer 1901 shows the amount of time (in seconds) the player has to take to take action (hit, stand, double) for table 2 in the table 2 betting area. If the player does not take action in the allotted time (e.g., the timer reaches zero), the player will automatically stand. Note that the countdown time for each table can be different (as illustrated), although in another embodiment they can be the same.

Figure 20:
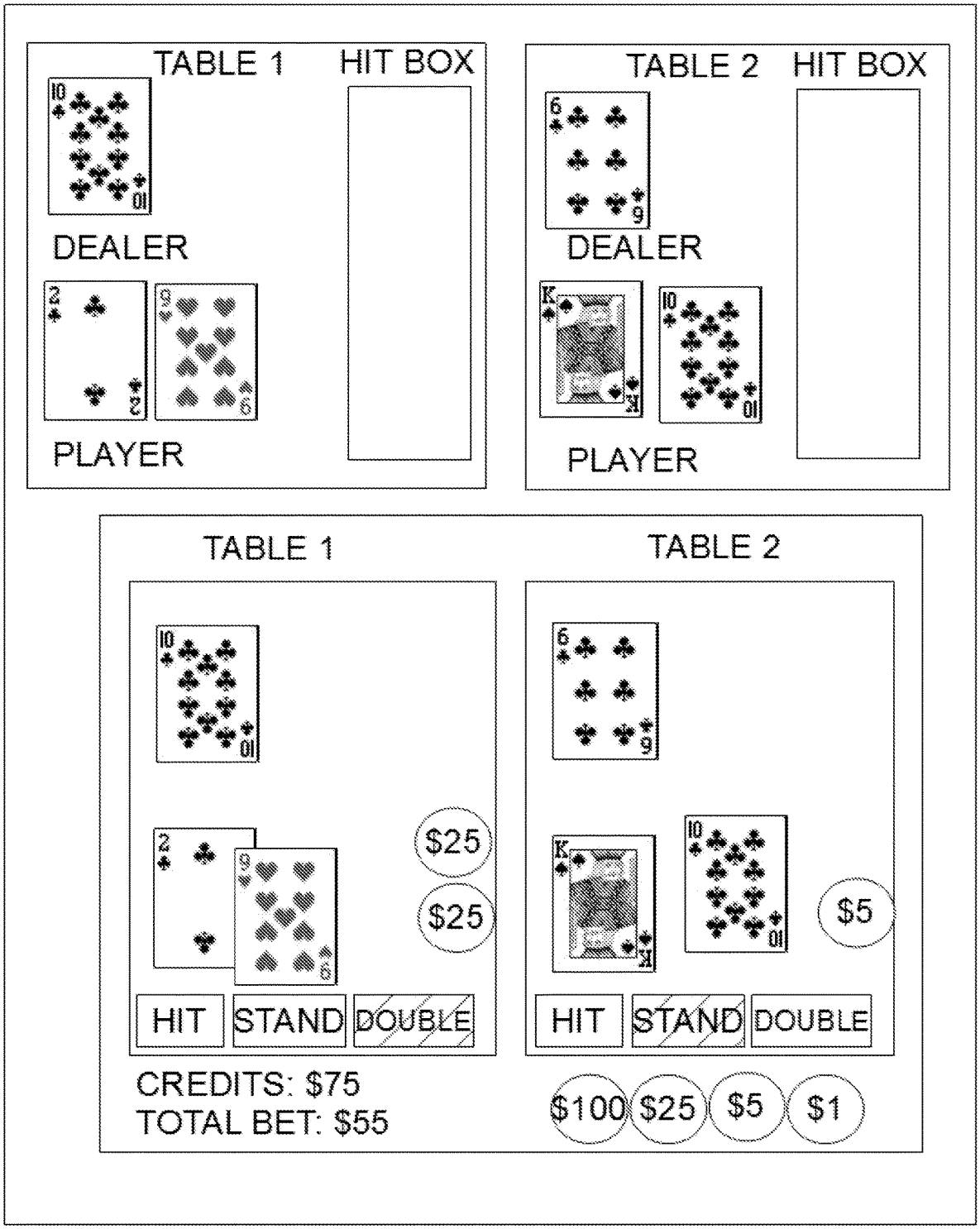
FIG. 20 is a drawing illustrating video outputs on a player on a player station at a third point in time, according to an embodiment.

FIG. 20 is a drawing illustrating video outputs on a player on a player station at a third point in time, according to an embodiment.

The player has chosen to double on the game from table 1 (wherein the table 1 betting area shows an additional bet placed) and the player has chosen to stand on the game from table 2. An additional $25 bet (equal in amount to the original wager amount) is automatically placed in the table 1 betting area when the player selects to double. The player can press the respective buttons (e.g., on a touch-screen) to indicate their chosen action.

Figure 21:
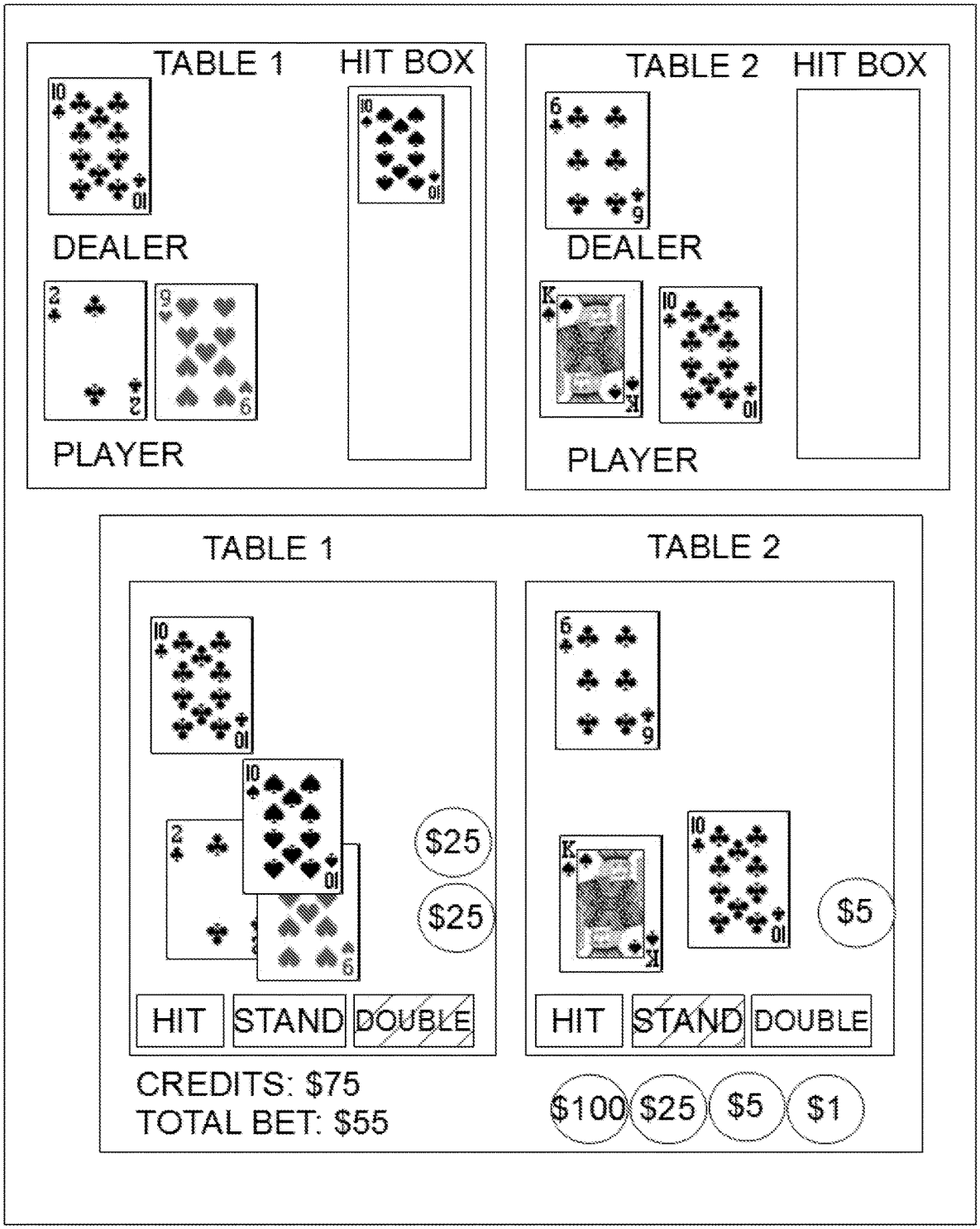
FIG. 21 is a drawing illustrating video outputs on a player on a player station at a fourth point in time, according to an embodiment.

FIG. 21 is a drawing illustrating video outputs on a player on a player station at a fourth point in time, according to an embodiment.

The player at this player station chose to double so a new card is needed. The dealer at table 1 dealt a card into the hit box (a 10-spades). After the dealer deals the player's initial two cards and the dealer's initial hand (either one card or two cards), all further cards are dealt by the dealer into the hit box. The 10-spades is animated in the table 1 betting area (the system knows the 10-spades was dealt in to the hit box because the cards are bar-coded and automatically scanned as they are dealt) and added to the player's hand, giving the player a total of 21.

Figure 22:
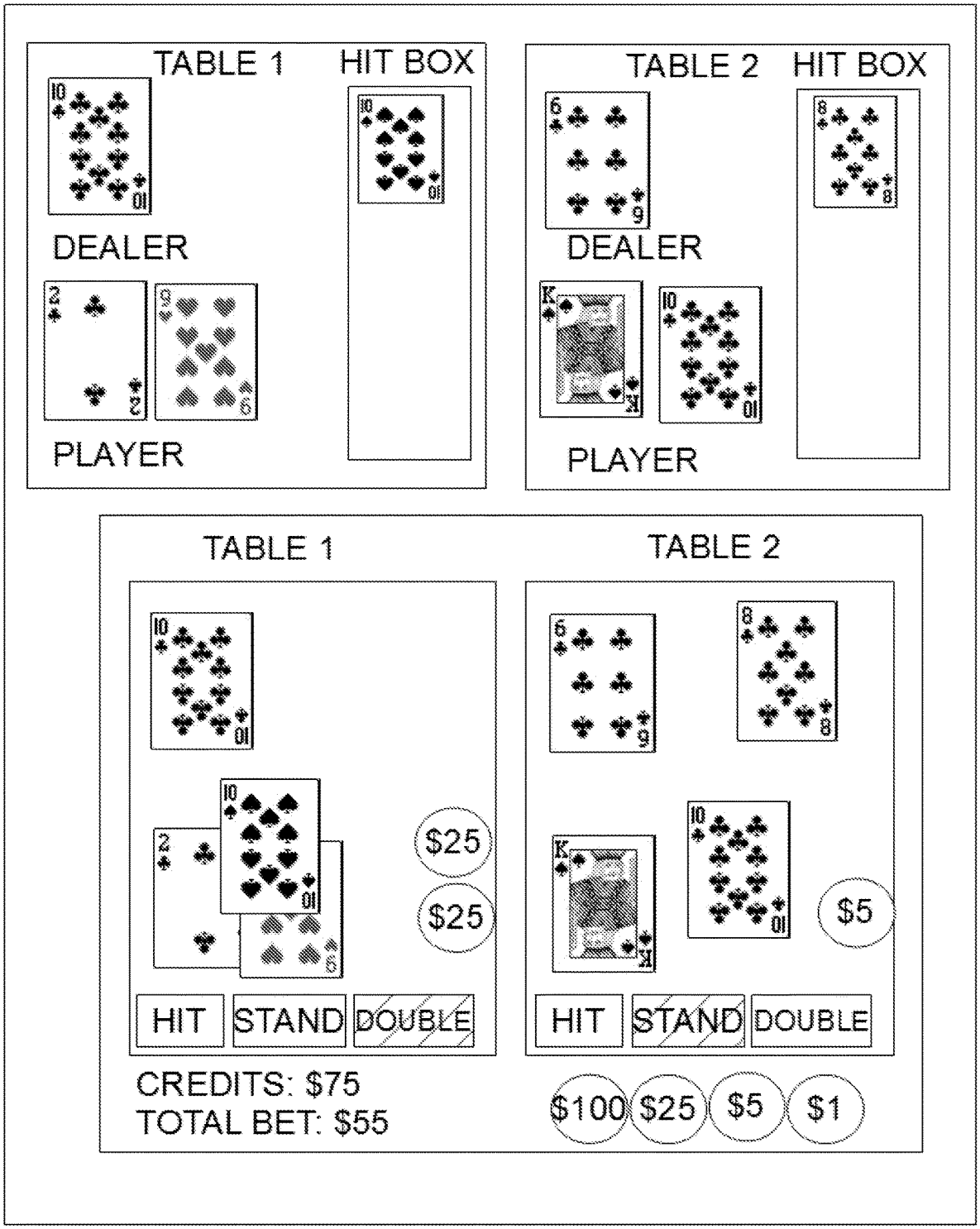
FIG. 22 is a drawing illustrating video outputs on a player on a player station at a fifth point in time, according to an embodiment.

FIG. 22 is a drawing illustrating video outputs on a player on a player station at a fifth point in time, according to an embodiment.

The player has stood in the table 2 betting area and the dealer dealt an eight-clubs in the table 2 hit box. Since the player is finished resolving his/her hand then the next card dealt into the hit box will be used as the dealer's second card. Thus, note that the eight-clubs shown in the table 2 video display is electronically placed in the table 2 betting area as the dealer's second card giving the dealer a total of 14. Since the total of 14 is less than 17, the dealer will hit (otherwise the dealer would stand).

Figure 23:
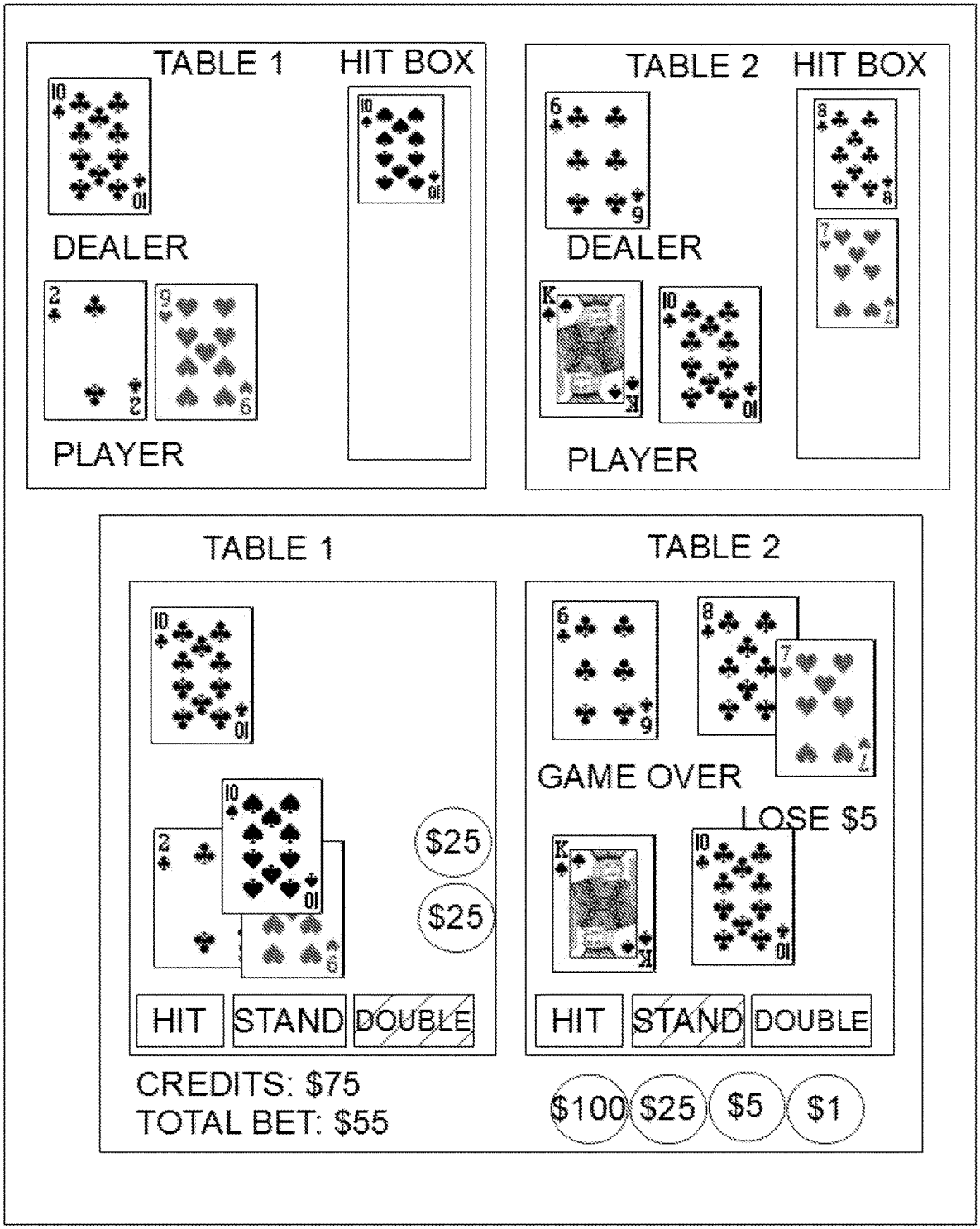
FIG. 23 is a drawing illustrating video outputs on a player on a player station at a sixth point in time, according to an embodiment.

FIG. 23 is a drawing illustrating video outputs on a player on a player station at a sixth point in time, according to an embodiment.

The dealer in table 2 (second dealer station) deals another card into the hit box: seven-hearts. Since in the table 2 betting area the dealer's total is less than 17 the dealer hits and thus uses the next card in the table 2 hit box (the seven-hearts) as the dealer's hit card. This gives the dealer's hand a total of 21 (which is greater than 16) so that the dealer now stands in the game in the table 2 betting area. Since the dealer's total of 21 is greater than the player's total of 20, the dealer wins (player loses) and thus the player loses the $5 wager on this game. This game is now over.

Figure 24:
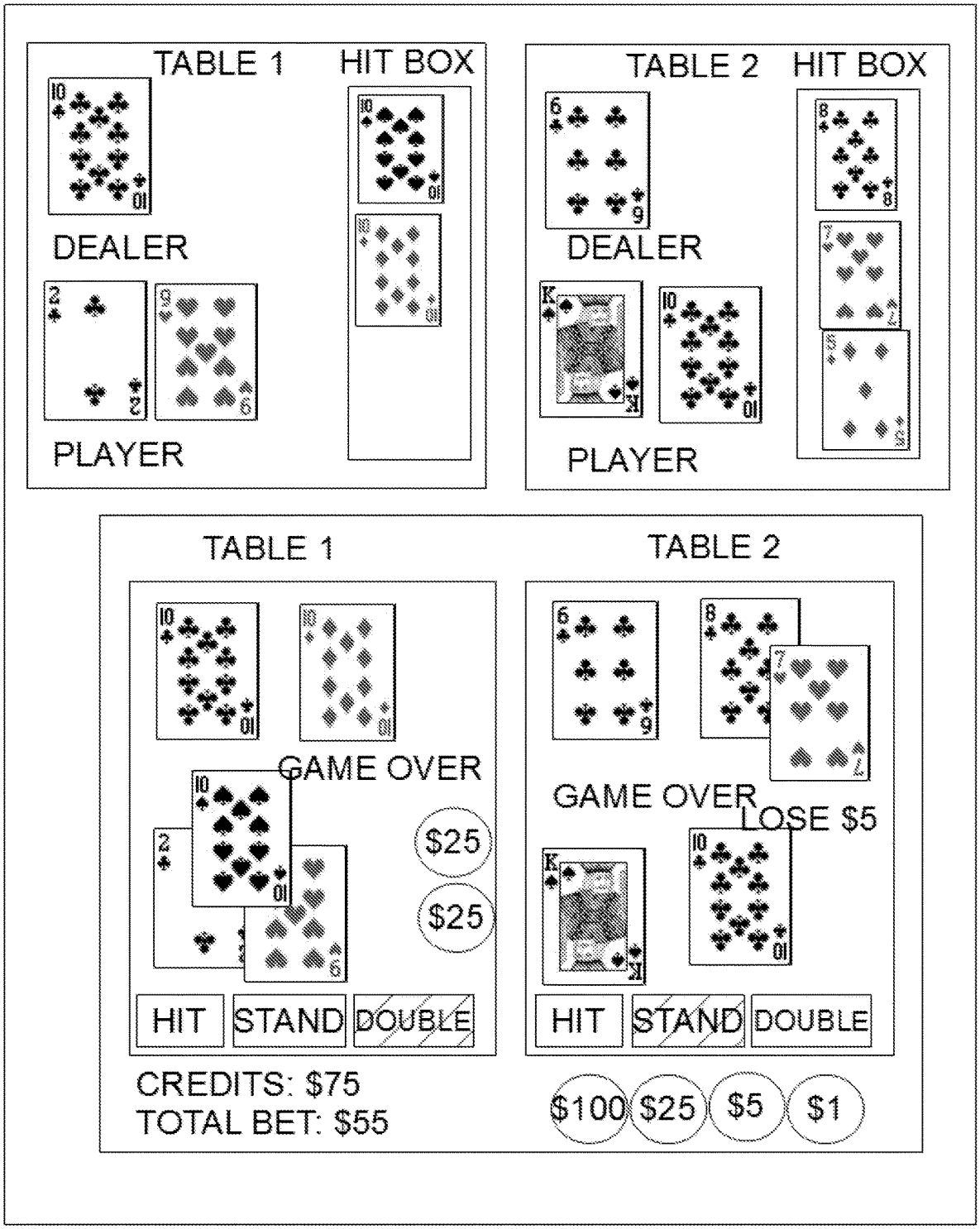
FIG. 24 is a drawing illustrating video outputs on a player on a player station at a seventh point in time, according to an embodiment.

FIG. 24 is a drawing illustrating video outputs on a player on a player station at a seventh point in time, according to an embodiment.

At the table 1 (first dealer station) the dealer deals another card (ten-diamonds) into the table 1 hit box, this card is used as the dealer's second card (since the player stands on his/her hand and thus no further cards are needed for the player's hand). Thus, in the table 1 betting area the ten-diamonds is shown as the dealer's second hand. This gives the dealer a point total of 20 (which is greater than 16 so the dealer stands). Thus, the game ends.

Figure 25:
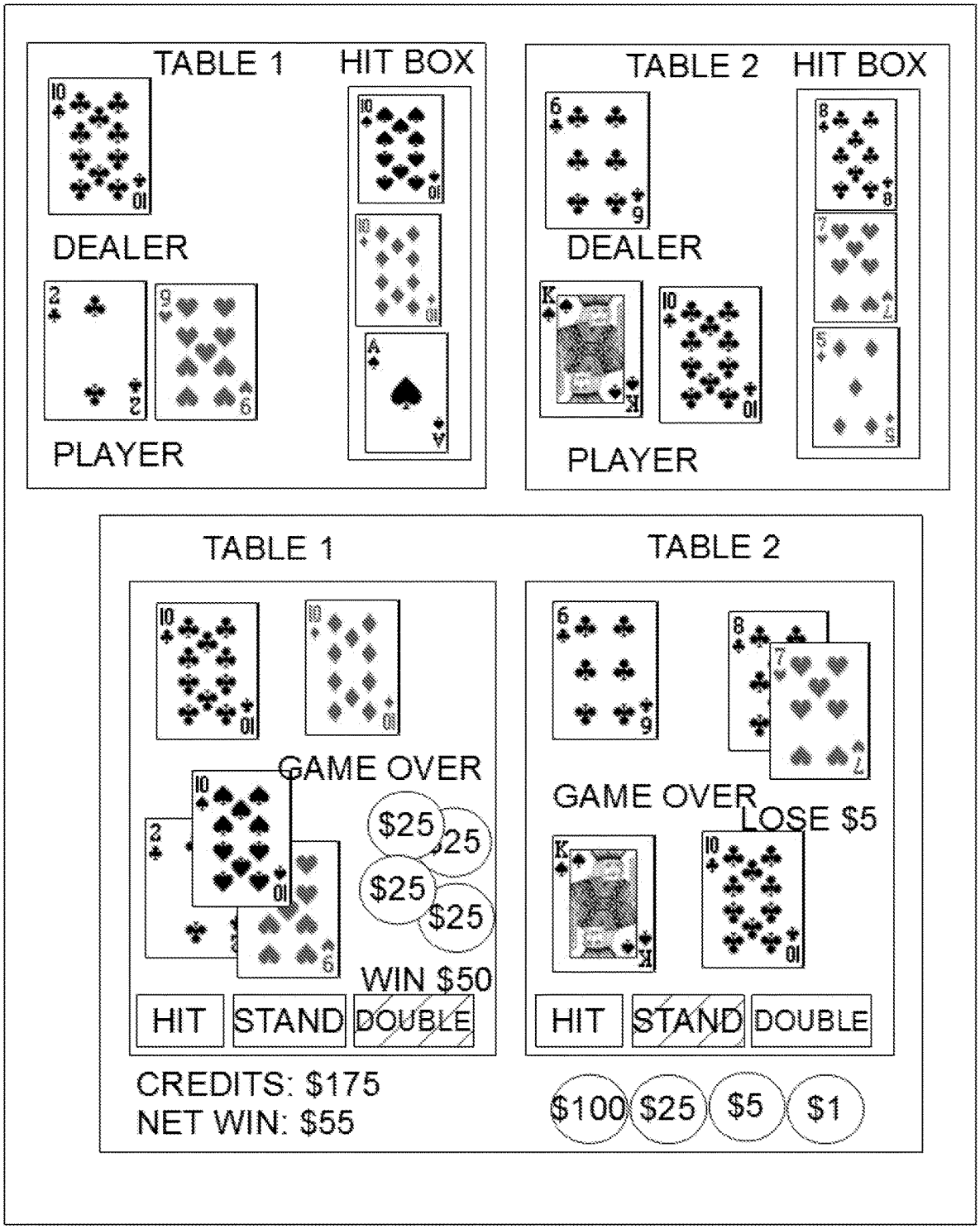
FIG. 25 is a drawing illustrating video outputs on a player on a player station at an eighth point in time, according to an embodiment.

FIG. 25 is a drawing illustrating video outputs on a player on a player station at an eighth point in time, according to an embodiment.

For the game players on table 1, since the player has a point total of 21 which is higher than the dealer's point total of 20, the player wins this game. Thus, the player wins an even money payout on the player's wager (including the double wager). Thus, the player wins $100 on the table 1 betting area (the original $50 bet plus the $50 in winnings). Note that the dealer at the first dealer station dealt an additional card in the table 1 hit box (ace-spades) but this card is not needed for the game in the table 1 betting area (since this game has already ended).

However, other players at other player stations may have played this game differently and thus the ace-spades could be used on their hand. For example, if a player hit their initial hand of 11 to get 21 and then hit their 21 (very dumb move) then they would receive the ten-diamonds on their 21 for a total of 31 (causing the player to bust and lose). The ace-spades would then be used in that game for the dealer's second card (although it would be moot because the player would have lost anyway by virtue of the player busting).

Figure 26:
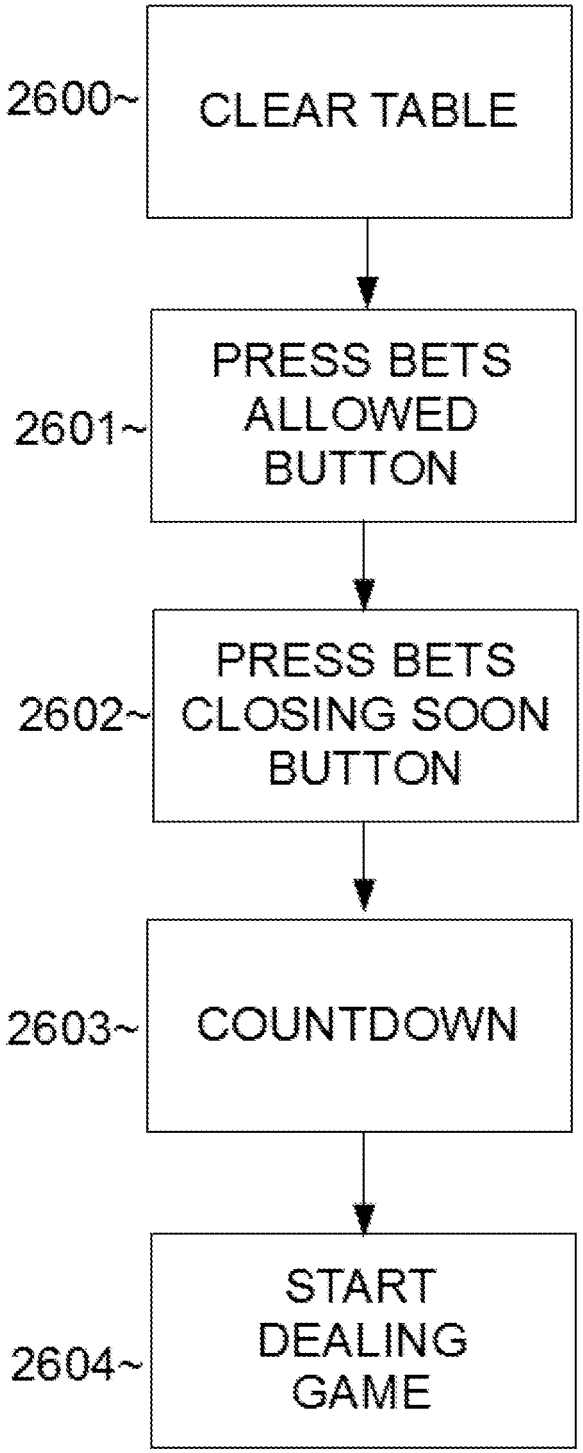
FIG. 26 is a flowchart illustrating an exemplary method of implementing a blackjack game on a networked system, according to an embodiment.

FIG. 26 is a flowchart illustrating an exemplary method of implementing a blackjack game on a networked system, according to an embodiment. The method illustrated in FIG. 26 is performed separately at each dealer station.

This method is performed similarly to the method illustrated in FIG. 6. Note that unlike in FIG. 6, the dealer does not have to identify the outcome (e.g., player win, loss, etc.) because since each player can play out their own hand as they wish, the system itself will automatically determine which players win or lose (by identifying each card dealt using computer readable markings on each card and determining the point value of the player's hand and the dealer's hand). The cards will be dealt in a predefined order (e.g., the player will deal both player's cards first and then the dealer's initial card(s) so that the system knows who has which cards).

In operation 2600, the dealer clears the table. This may also entail shuffling the cards, if necessary.

From operation 2600, the method proceeds to operation 2601, in which the dealer presses a "bets allowed" button on the dealer's station. This allows the system to begin taking bets on the forthcoming game at this particular dealer station.

From operation 2601, the method proceeds to operation 2602 in which the dealer presses a bets closing soon button which starts a countdown time (e.g., 10 seconds) before bets are closed on the forthcoming game at this dealer station.

From operation 2602, the method proceeds to operation 2603, which maintains and displays the actual countdown (e.g., 10 second countdown).

Once the countdown ends, a light or indicator at the dealer station indicates to the dealer that the dealer can now start dealing the game. The dealer would then start dealing the game (e.g., player's hand, dealer's hand, etc.) Cards are dealt in a predefined order so that the system knows where each card dealt out of the shoe (identified by barcode or other identifier) will be placed (e.g., part of player's hand, dealer's hand, hit box).

The method illustrated in FIG. 8 (and the accompanying description) is also used in the embodiment which offers a blackjack game. It is noted that operations 806-807 would comprise operations 1701 to 1715 from FIG. 17).

Figure 27:
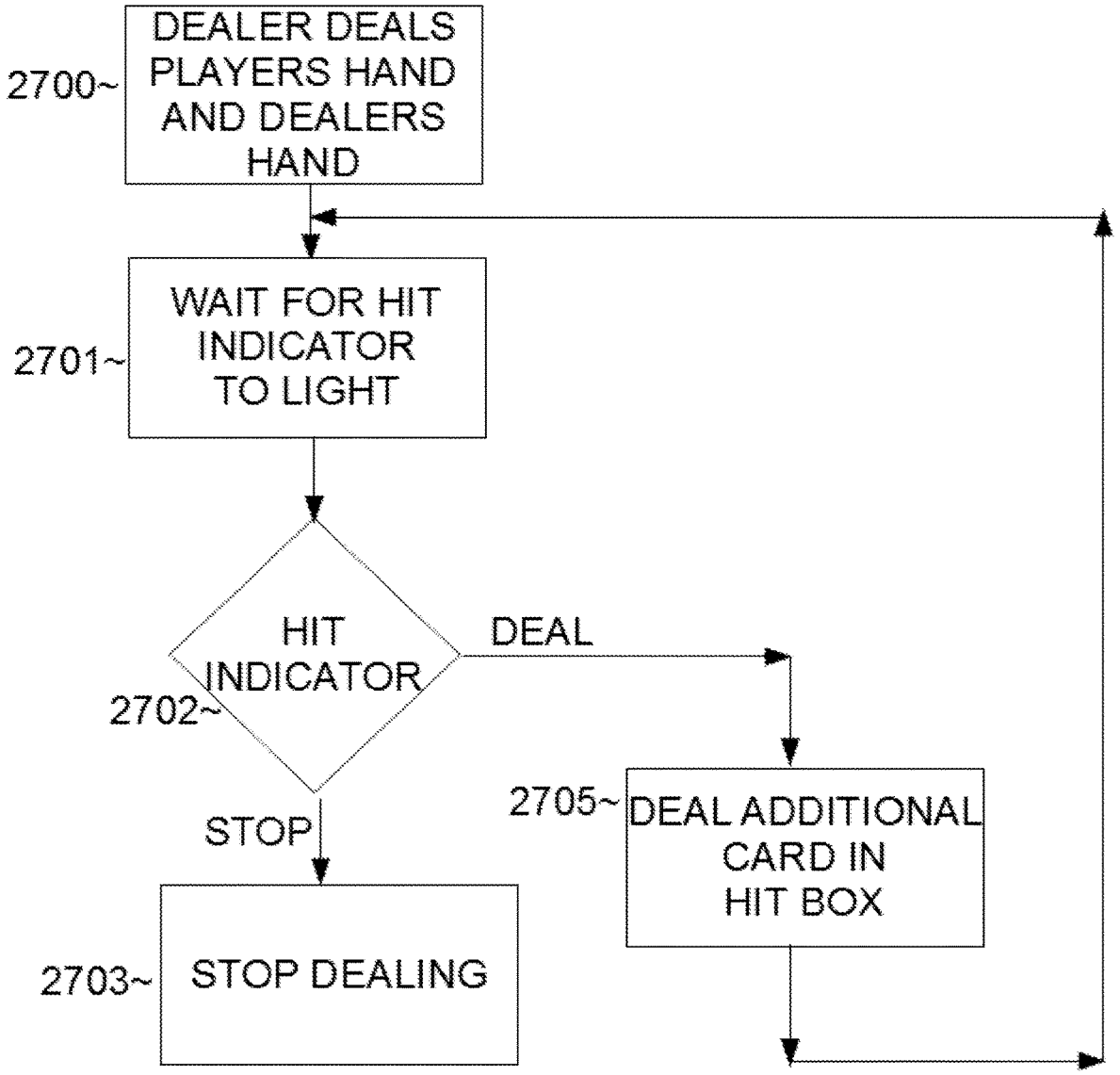
FIG. 27 is a flowchart illustrating an exemplary method of a dealer dealing a blackjack game, according to an embodiment.

FIG. 27 is a flowchart illustrating an exemplary method of a dealer dealing a blackjack game, according to an embodiment. The dealer at each dealer station would deal according to this method.

In operation 2700, the dealer would deal the player's hand and the dealer's hand. The player's hand is typically two cards dealt face up. The dealer's hand is either one card face up (European hole-card rule) or one card face up and one card face down (American hole card rule), system can be told (initialized) to use the American or European rule at the admin station 409. The cards would be dealt in a predetermined order so that the system knows which card belongs to which hand. If the American rule is being used then the system expects the first four cards dealt out to form the player's and dealer' hands. If the European rule is being used then the system expects the first three cards dealt out to form the players and dealer's hand. The number of cards dealt is sensed by the electronic scanning/sensing shoe.

After the dealer has dealt the player's hand and the dealer's hand, the method proceeds to operation 2701, wherein the dealer waits for a hit indicator to light. The hit indicator is a set of physical lamps or indicators on an electronic output device that light up in order to instruct the dealer as to what to do next. For example the hit indicator can be two lights/icons ("deal" or "stop"). If the deal light lights up, then the method proceeds to operation 2705 wherein the dealer deals a hit card face up in the hit box. The method then returns to operation 2701.

If in operation 2702, the stop light/icon lights up then the dealer can stop dealing as the game is over. In one embodiment, the dealer would wait for another light (a "clear" indicator) before clearing the cards from the table (which can be timed to occur a predetermined amount of time (e.g., 20 seconds) after the stop light lights up). In another embodiment, the dealer can simply wait on their own (e.g., 20 seconds) before clearing the cards off of the table.

Figure 28:
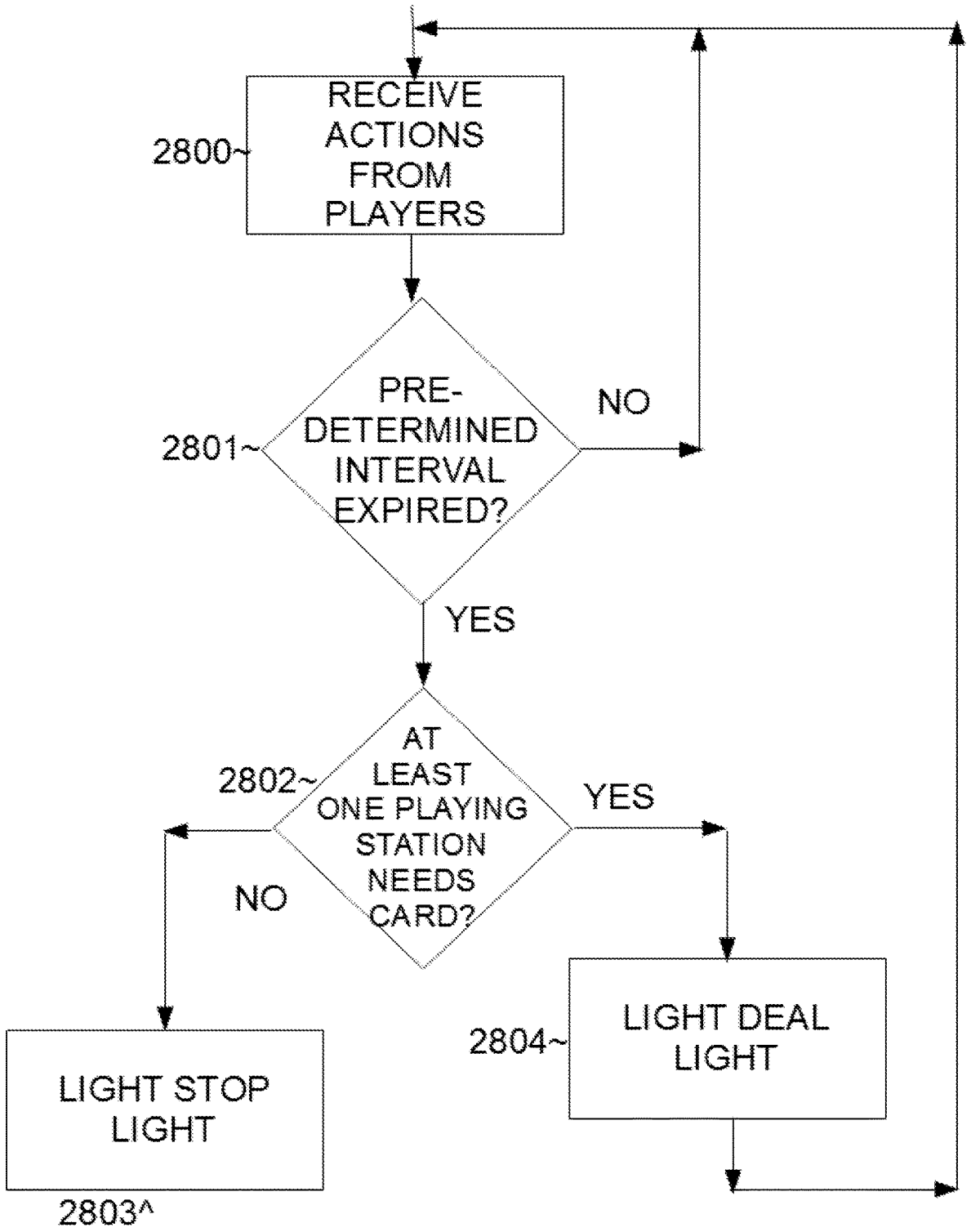
FIG. 28 is a flowchart illustrating an automatic determination of which light on a dealer's station to light, according to an embodiment.

FIG. 28 is a flowchart illustrating an automatic determination of which light on a dealer's station to light, according to an embodiment. The method in FIG. 28 is performed for each game at each dealer station. Thus, if a player station is playing two simultaneous games, then the method in FIG. 28 could be performed twice (one for each game/dealer station). The system is networked and in communication with each player station. The dealer will keep dealing cards in the hit box until no further cards are needed. Then the game can end and all bets can be resolved (winners paid and losing bets taken). Before each card is dealt into the hit box, players are given an interval of time (e.g., 10 seconds) in order to decide which action to take (e.g., hit, stand, double, split or whichever ones are available). Of course, the player should not see the next card dealt into the hit box until the player has taken their respective action. However, there should typically be a limited amount of time for each player to take action, otherwise one player could hold up the game (and all of the other players).

In operation 2800, player actions are received (by each player station which are then transmitted to the database/server which controls the entire game/system) after the initial hands are dealt (e.g., hit, stand, double, split). In operation 2801 it is determined if the predetermined interval has expired. If not, the method returns to operation 2800 which continues receiving actions from players. Players indicate their desired action by pressing a virtual button on a touch screen (or using another input mechanism such as a physical button, mouse, keyboard, etc.)

If in operation 2801, the predetermined interval has expired, then the method proceeds to operation 2802, which determines whether at least one player station needs a card. When a player at a player station takes an action (in operation 2800) that requires an additional card (e.g., hit, double, split) then a new card would be needed and the player station would send an electronic request to the database/server which proceeds to operation 2804 which causes the deal light to light at the respective dealer station. If multiple players each need a card then the deal light would only be lighted once (because one card dealt can then be applied to each of the players that need a card). The method then returns to operation 2800 which continues to poll player stations (operations 2800/2801) to see if any player station needs another card (operation 2802).

If in operation 2802, no player station needs another card (e.g., all players for this game have finished their games and no further cards are needed) then the method proceeds to operation 2803, wherein the database/server causes the stop light at the dealer station to light up. This tells the dealer that no further cards need to be dealt.

Figure 29:
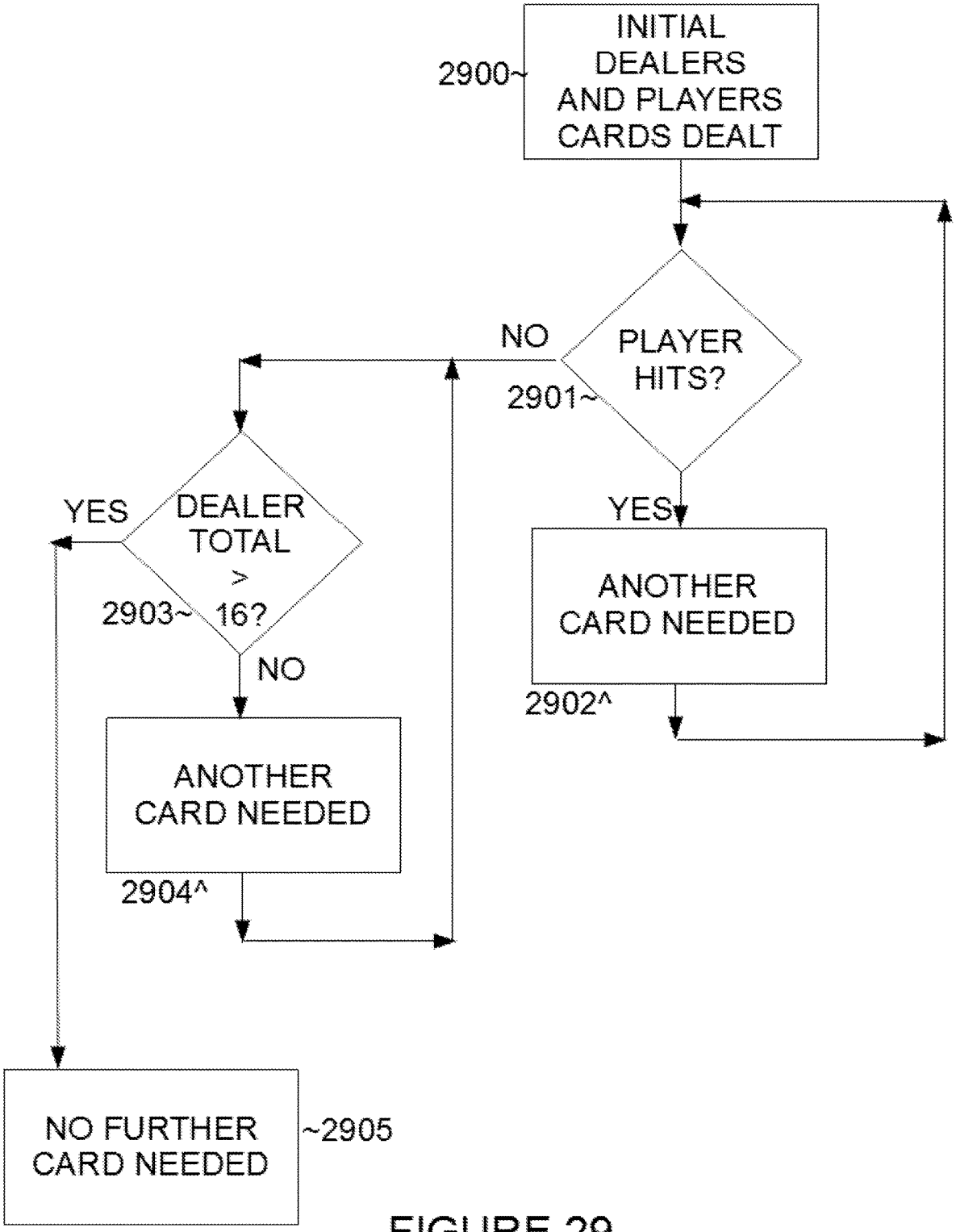
FIG. 29 is a flowchart illustrating an automatic determination at each blackjack game being played at each player station if another card is needed, according to an embodiment.

FIG. 29 is a flowchart illustrating an automatic determination at each blackjack game being played at each player station if another card is needed, according to an embodiment. Each player station would communicate with the dealer station (through the database/server) whether it needs another card for the game or not. If the player station is simultaneously playing two different side by side games, then the method in FIG. 29 would be implemented for each game (e.g., each game is treated independently by the player station).

In operation 2900, initial dealers and players cards are dealt. This is done by the dealer at a dealer's station, as described herein. As each card is dealt, the system recognizes each card and registers what the initial dealer's hand and the initial player's hand are.

From operation 2900, the method proceeds to operation 2901 which determines if the player hits. If the player doubles this also is considered as a hit (since a player needs another card). If the player splits, this would also be considered a hit since the player would also need more cards. If the player stands, this would not be considered a hit since the player would not need another card. If the player hits, then the method proceeds to operation 2902, wherein another card is needed. The player station would transmit this request to the database/server which would then process the request for another card (see FIG. 28) and light up the hit light at the dealer station. The hit light would not light immediately but after the predetermined interval (see FIG. 28). The method can return to operation 2901.

If in operation 2901, the player does not hit (or any other action that requires another card for the player's hand) then the method proceeds to resolve the dealer's hand. In operation 2903, it is determined if the dealer's total is greater than 16 (typically a dealer would hit until the dealer has a point total of 17). If the dealer total is not greater than 16, then the method proceeds to operation 2904 wherein another card is needed. The player station would transmit this request to the database/server which would then process the request for another card (in the same manner as operation 2902) and light up the hit light at the dealer station. The hit light would not light immediately but after the predetermined interval (see FIG. 28). When the card is dealt in the hit box, it is added to (displayed at) the dealer's hand in the respective betting area at the player station and the card's total is added to the dealer's point total. The method can then return to operation 2903.

If in operation 2903, the dealer total is greater than 16, then the dealer does not need to draw another card and the method proceeds to operation 2905. This player station (for this particular game at the dealer station) does not need another card and it can be transmitted to the database/server that no additional card is needed (or alternatively no such transmission is necessary).

Figure 30:
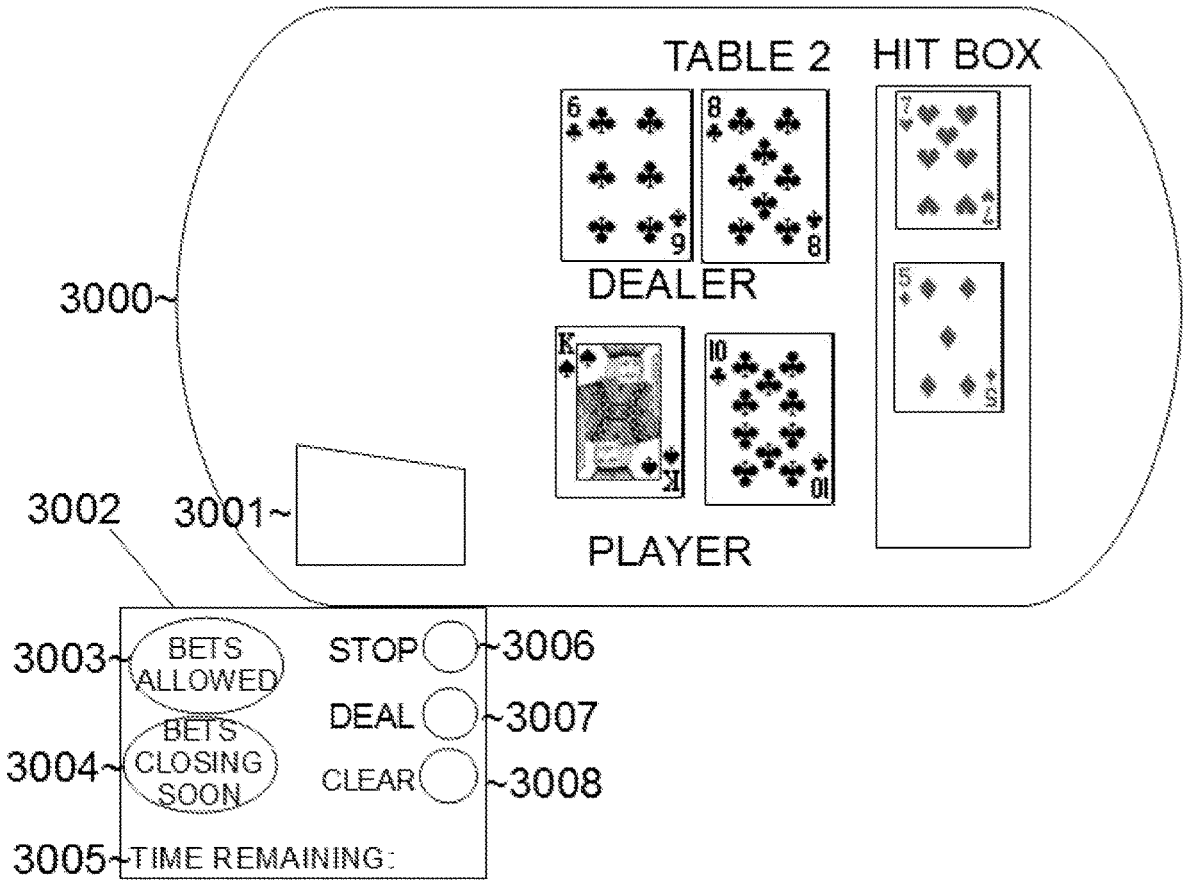
FIG. 30 is a drawing of a dealer station for a networked blackjack game, according to an embodiment.

FIG. 30 is a drawing of a dealer station for a networked blackjack game, according to an embodiment.

A table 3000 is used to deal the game on. A shoe 3001 is used to deal the cards out of. The shoe 3001 can have an electronic scanner (or sensor) to either: 1) optically recognize the face of the cards as they are dealt out of the shoe; or 2) identify a barcode or some other computer readable identifier so that as each card is dealt out of the shoe, the card value (rank and suit) are identified and transmitted to the system (so each hand can be digitally reconstructed in the betting area on each player station). While the hit box shown only accommodates three cards, the hit box can accommodate any number of cards are cards can be dealt to overlap other cards.

A dealer station interface 3002 is used so the dealer can interact with the system. The interface can be entirely digital (e.g., a touch-screen display) or mechanical (lights and buttons) or a combination of both. A bets allowed button 3002 is pressed by the dealer when a new game is going to begin and the dealer wants to allow bets on the game. Once the bets allowed button 3003 is pressed, then players at player stations can start to place bets on the game that will be dealt next at this dealer station. A bets closing soon button 3004, when pressed, starts a countdown timer 3005 (which is also displayed at the player stations) upon which when the countdown ends, no further bets on the forthcoming can be placed and the dealer would start dealing the game.

A deal light 3007 tells the dealer to deal a single card into the hit box. A stop light 3006 tells the dealer to stop dealing further cards. A clear light 3008 tells the dealer he/she can clear all of the cards from the table, shuffle (if necessary) to prepare for a new game. An optional "initial hand dealt" button can be used which the dealer presses once the initial hands (the player's hand of 2 cards and the dealer's hand of 1 or 2 cards) are first dealt (to tell the system that the initial hands are now dealt and the players can now take action), however this button is not necessary because the scanning shoe can detect how many cards have been dealt and when the appropriate amount (4 for the American rule and 3 for the European rule) are dealt then the system knows initial hands are dealt and it is now time to allow players to decide their strategy (in operations 1702/2800/2901).

An example of a blackjack game played at two dealer stations (dealer station 1 and dealer station 2) with two player stations (player station 1 and player station 2) will now be presented to help illustrate the system. Of course, other embodiments can have more dealer stations (which would all operate similarly as described herein) and more player stations (which would all operate similarly as described herein), but two of each are used in this example for simplicity.

Dealer 1 (at dealer station 1) presses the "bets allowed" button. Dealer 2 (at dealer station 2) presses the "bets allowed" button. Player 1 (at player station 1) makes a $1 wager on game 1 (to be played at dealer station 1 dealt by dealer 1). Player 1 makes a $2 wager on game 2 (to be played at dealer station 2 dealt by dealt 2). Player 2 does not make any wagers yet.

Dealer 1 presses the "bets closing soon" button which starts the countdown timer (from 10 seconds) for table 1. The countdown timer is displayed for table 1 on both player stations. Player 2 bets $5 on game 1. When the countdown timer for table 1 is at 5 seconds then dealer 2 presses the "bets closing soon" button which starts the countdown timer for table 2 which is displayed at both player stations. The countdown timer on table 1 runs out which closes bets on table 1. Five seconds later, the countdown timer on table 2 runs out which closes bets on table 2. Player 2 did not make a wager on game 2.

Dealer 1 now deals game 1 and deals an initial player's hand (two cards face up) of 6-diamonds/3-hearts (point total of 9) and an initial dealer's hand (one card face up) of 10-spades. Video of this (game 1) is broadcast live to both player stations. Also displayed at both player stations is a virtual game display (separate from the live video) of computer generated images of game 1. The virtual game display is illustrated in FIGS. 19-25 (table 1 betting area 1805 and table 2 betting area 1806). Thus, virtual cards for the dealer's hand and the player's hand are displayed simulating a real game. Dealer 2 now deals game 2 and deals an initial player's hand (two cards face up) of 5-clubs/8-clubs (point total of 13) and an initial dealer's hand of ten-hearts. Video of this (game 2) is broadcast live to both player stations. Also displayed at both player stations is a computer generated window (separate from the live video) of computer generated images of game 2.

A countdown timer is now displayed on both player stations for each game (the countdowns do not necessary need to be in sync with each other). Each player must place take action on game 1 before the game 1 countdown timer has expired (reaches 0), and similarly must take action on game 2 before the game 2 countdown timer has expired (reaches 0).

Player 2 decides to double on game 1 and presses a "double" button on player station 2. An additional $5 wager (chip) is displayed on game 1 by the computer and deducted from the player 2's credits. No cards for this game are dealt yet until the countdown timer for game 1 expires. Player station 2 requests to the system that a card is needed (operation 2902) for game 1.

Player 1 decides to hit on game 1 and presses a "hit" button on player station 1. No cards are dealt for game 1 yet until the countdown timer for game 1 expires. Player station 1 requests to the system that a card is needed (operation 2902) for game 1. Player 1 decides to hit on game 2 and presses a "hit" button on player station 1. No cards are dealt yet for game 2 until the countdown timer for game 2 expires. Player station 2 requests to the system that a card is needed (operation 2902) for game 2.

The countdown timer for game 1 (dealer station 1) runs out first and a "deal" light lights up on dealer station 1. Dealer 1 now deals a card into the hit box at dealer station 1 (2-diamonds). While this is displayed via video on both player stations, additionally a computer generated image of the 2-diamonds is added to each player station's separate virtual game display for game 1. A new countdown timer for game 1 (dealer station 1) now starts again from 10 seconds. Player 1 now has a point total of 11 and can take action (hit or stand) before the countdown timer for game 1 expires. Player 1 decides to hit and presses the respective "hit" button on player station 1. Player station 1 requests to the system that a card is needed (operation 2902) for game 1. Player 2 also has a point total of 11 but since player 2 doubled (note that when a player doubles he/she is limited to taking only one card and then must stand), player 2 cannot take any further action for game 1 and must await the resolution of the game. Player station 2 requests to the system that a card is needed (operation 2904) for game 2 (to resolve the dealer's hand).

The countdown timer for game 2 (dealer station 2) now runs out and a "deal" light lights up on dealer station 2. Dealer 2 now deals a card into the hit box at dealer station 2 (10-spades). While this is displayed via video on both player stations, additionally a computer generated image of the 10-spades is added to each player station's separate virtual game display for game 2. Player 1 has a point total of 23 for game 2 which is a bust (greater than 21) which means that player 1 automatically loses this game. Thus, player 1 loses his $2 wager on game 2. Since there are no further live players (player 2 did not bet on game 2) in game 2 (no further cards for players need to be dealt), a countdown timer for game 2 does not need to be displayed since game 2 ends here. No request is made by player station 1 for another card for game 2 (since the game is over). At dealer station 2 a "stop" light can light up (operation 2803) telling the dealer to stop dealing further cards. If the American hole card rule is being employed, the hole-card would be revealed to the player. Alternatively, a countdown timer can be displayed and additional cards can still be dealt to resolve the dealer's hand (so players can see what hand the dealer would have ended up with) which would mean a request would be sent by player station 1 for an additional card to resolve game 2.

The countdown timer for game 1 (table 1) now runs out and the dealer deals a second card into the hit box on table 1. This card is an 8-hearts. While this is displayed via video on both player stations, additionally a computer generated image of the 8-hearts is added to each player station's separate virtual game display for game 1. The 8-hearts is added to the player's hand in player station 1 and the 8-hearts is added to the dealer's hand (because player 2 is not drawing) in player station 2 (thus the 8-hearts will appear in two different locations on each player station). A new countdown timer for game 1 (dealer station 1) now starts again from 10 seconds. Player 1 now has a point total of 19 and can take action (hit or stand) before the countdown timer for game 1 expires. Player 1 decides to stand and presses the respective "stand" button on player station 1. Player station 1 requests to the system that a card is needed (operation 2904) for game 1 (to resolve the dealer's hand). Player 2 has a point total of 11 but since player 2 had doubled, player 2 cannot take any further action for game 1 and the card that was dealt into the hit box (8-hearts) is given to the dealer's hand for player 2 at player station 2. At player station 2, the dealer's total for game 1 is now 18 (the original 10-spades dealt plus the 8-hearts dealt). Thus, player 2 loses game 1 because the player's hand total of 11 is lower than the dealer's total of 18. Thus, player 2 loses his/her $10 wager (the $5 original wager plus the $5 double wager). Player 2 can now watch game 2 on video until game 2 is over for all players and dealer 2 presses the "bets allowed button" on dealer station 2, upon which player 2 can now bet on dealer station 2 again.

After the countdown timer for game 1 expires, dealer 1 is now going to resolve the dealer's hand (starting at operation 1706). Dealer 1 deals a seven-spades into the hit box at dealer station 1. This is broadcast on video to both player stations and is added to the dealer's hand at the virtual game display for player station 1 (game 1 at player station 2 is over and is not added to the virtual game display for player station 2). At player station 1, game 1, the dealer's hand total is now 17 (the original 10-spades plus the last dealt 7-spades). Player 1's point total for game 1 is 19 (the initial hand of 9 plus the 2-diamonds dealt into the hit box plus the 8-hearts dealt into the hit box). Thus, since player 1's point total (19) is higher than the dealer's point total (17), player 1 wins game 1 at player station 1 and wins a $1 payout for his $1 wager he/she originally made on game 1. Note that in game 1, the dealer's final total is different from player station 1 and player station 2. This is because, depending on how each player players their hand (their strategy decision, e.g., hit, stand, double, split, etc.) cards in the hit box can be allocated to differently (either to the player or dealer). Cards in the hit box are first allocated to the player, and when the player is done taking cards then subsequent cards dealt in the hit box are allocated to the dealer. Thus it is possible that different players at different player stations may achieve different results in the same game (e.g., one player may win while another may lose) because they play out their hands differently and independently. If players at different player stations play their hands the same in the same game then they would achieve the same results.

Of course, any number of players (each at their own player station) can play one or more blackjack games as described, and each player is free to pursue their own independent betting and playing strategy (hit, stand, double, split, etc.) for each game.

In one embodiment, each dealer station only has one player hand that players can play. In another embodiment, each dealer station can have more than one player hand (e.g., 2, 3, or more) to which the player (before any cards are dealt) can select which of the player hands (spots) the player wishes to use as their initial two cards.

Figure 31:
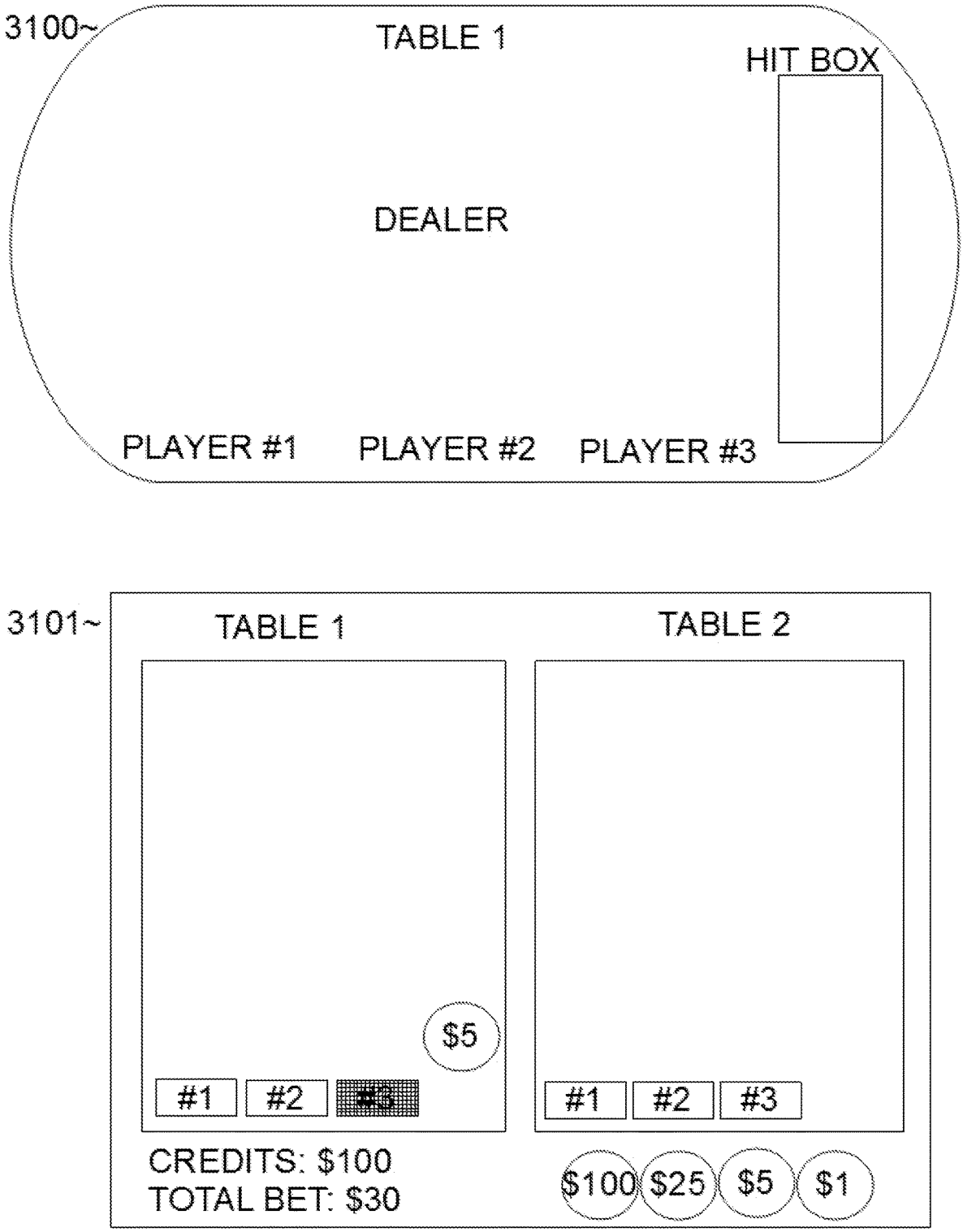
FIG. 31 is a drawing of a dealer station which offers three player hands and video outputs on a player station which allows the player to choose one of the three player hands, according to an embodiment.

FIG. 31 is a drawing of a dealer station which offers three player hands and video outputs on a player station which allows the player to choose one of the three player hands, according to an embodiment.

A dealer station 3100 can have three player spots (player #1, player #2, player #3). A betting screen 3101 on a player station allows the player to choose (before cards are dealt) which player spot (player #1, player #2, player #3) the player wishes to bet on by pressing one of the three buttons (#1, #2, #3). Also present (but not pictured) is the video display on the player station of the dealer station 3100 (which would show all three player spots being dealt). In each player spot, two initial cards are dealt. In this example, the player has selected #3 on table 1 and has not selected a hand on table 2 (meaning the player does not bet on the upcoming game on table 2). The player bets $5 on the upcoming game.

Figure 32:
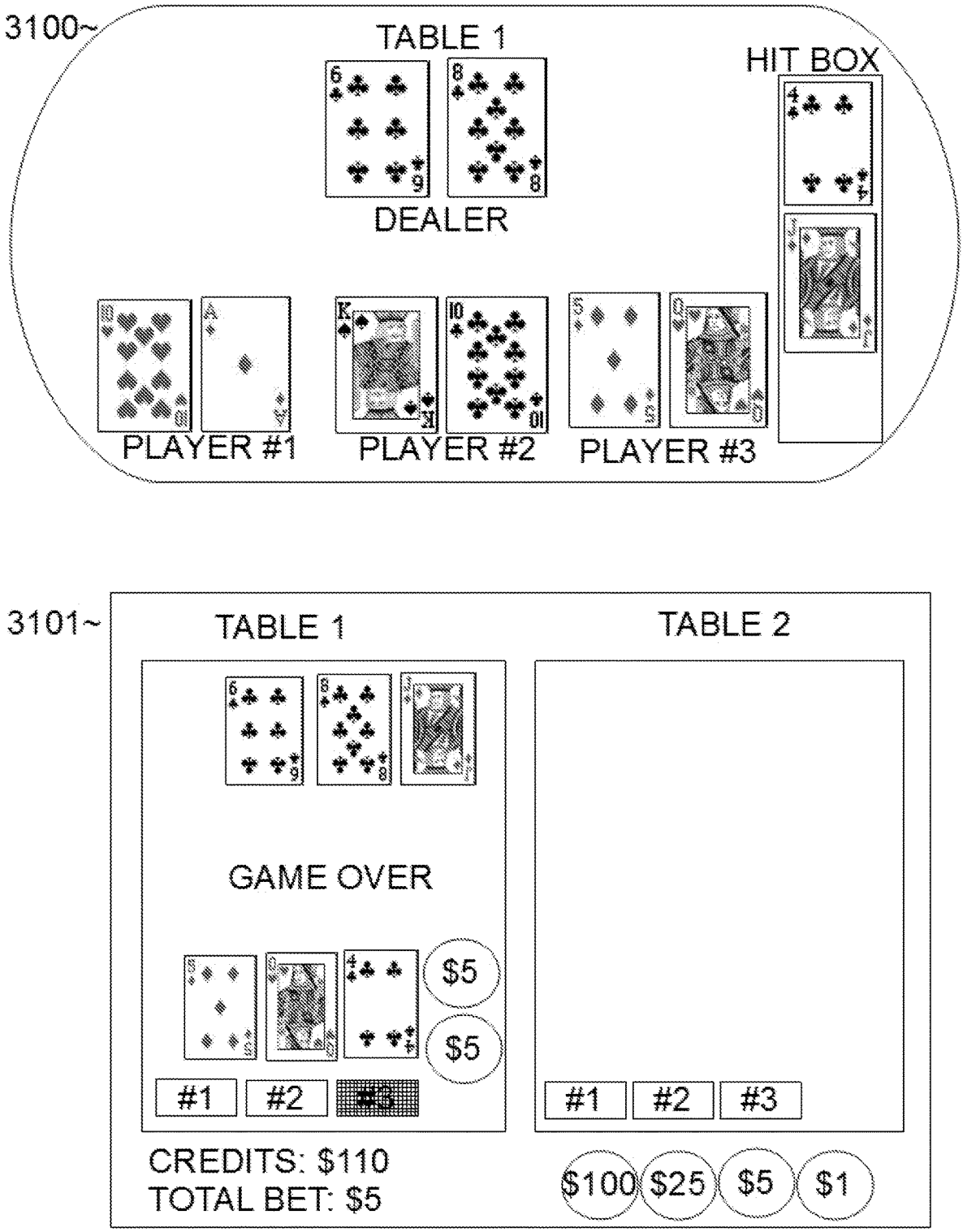
FIG. 32 is a drawing of a dealer station which offers three player hands and video outputs on a player station which allows the player to choose one of the three player hands after the game is over, according to an embodiment.

FIG. 32 is a drawing of a dealer station which offers three player hands and video outputs on a player station which allows the player to choose one of the three player hands after the game is over, according to an embodiment.

Since the player chose player spot #3, the betting screen (which shows the computer generated game) shows the initial two cards dealt at spot #3 (5-diamonds/queen-hearts) as the player's two initial cards. The player hit and received the first card in the hit box (4-clubs) to which the player stands. The dealer reveals his cards to have a total of fourteen to which the dealer hits and receives the next card in the hit box (since no other player in the system needed another card) which is a jack diamonds, causing the dealer to bust. Thus, this player has won his $5 wager.

Note that if the player had chosen spot #1, then the player's initial two cards would have been the 10-hearts/ace-diamonds (blackjack) which would immediately win and pay 3:2 of the player's wager. Once the player's initial two cards are determining using the player's selected player spot, the rest of the game proceeds according to the same methods described herein. Typically, the player would not be allowed to bet on more than one player spot on the same dealer station per game, although in another embodiment the player would be allowed to bet on more than one player spot on the same dealer station per game.

In one embodiment, the player would be allowed to spectate (e.g., watch the live video broadcast) and play at one or two (at the player's choice) tables simultaneously. In another embodiment, the player can spectate at two tables simultaneously but is only permitted to play at one table (selected by the player) of the two tables. Note that in FIG. 32, the player has decided not to play at a second table (although video (not pictured) can still be simulcast from a second table).

All of the embodiments, features, systems, methods, etc., described herein can be applied to blackjack games as well. For example, tournament play and online play can be applied to blackjack games.

In a further embodiment, a player station can mix different types of games. For example, a player station can offer a player to wager on both a blackjack game and a baccarat game, as described herein. Note that all player stations are typically alike, so a description of one player station would apply to all other player stations (except for identifying information respective to each player station). Note that all dealer stations are typically alike, so a description of one dealer station would apply to all other dealer stations (except for identifying information respective to each dealer station).

It is noted that some servers, databases, or other components of the system may actually comprise a number of distributed components and may be illustrated and described herein in the singular for simplicity. All parts of the system described herein also comprise the necessary communication mechanisms as well (e.g., cables, bus, coders/decoders, switches, etc.) to communicate with all other parts of the system.

All games described herein can be dealt using one or more physical deck(s) of cards. Standard decks of 52 cards can be used or special decks can be used (e.g., Spanish decks, decks with a joker/wildcard, etc.) Any known variation of rules can be used. Other known hardware can be used as well, including electromechanical card shufflers, player tracking mechanisms, etc.

Any description of a component or embodiment herein also includes hardware, software, and configurations which already exist in the prior art and may be necessary to the operation of such component(s) or embodiment(s). All buttons/interface functionality shown and described have the functionality as indicated.

Further, the operations described herein can be performed in any sensible order. Any operations not required for proper operation can be optional. Further, all methods described herein can also be stored on a computer readable storage to control a computer.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

We claim:

1. A method of conducting the operations of a wagering game, the method comprising:

providing a dealer station at which a live dealer may control the play of the game, the dealer station including a dealer touchscreen;

providing a plurality of player stations each possessing a player touchscreen by which an associated player may participate in the game by placing a bet;

displaying on the dealer touchscreen a virtual bets allowed button, the touching of which will initiate a first countdown displayed on each player touchscreen;

causing the virtual bets allowed button to be touched by the live dealer;

after the touching of the virtual bets allowed button, receiving from at least one of a plurality of players via an associated player touchscreen a bet for the at least one player to participate in the game;

when the first countdown has been completed, visually displaying on the dealer touchscreen a signal for the live dealer to begin an initial game sequence performed at the dealer station selected from the group consisting of distributing physical cards, rolling at least one physical die, and spinning a physical roulette wheel in which a physical ball is placed;

initiating via the live human dealer the initial game sequence;

displaying a visual representation of the initial game sequence on each of the associated player touchscreens where a player placed a bet to participate in the game;

completing the play of the game for each player who placed a bet;

determining a game outcome for the bet placed by each player;

displaying information regarding the game outcome on each of the associated player touchscreens where a player placed a bet;

displaying on each of said player station touch screens where a bet was received a region for allowing a tip to be given to said dealer, the region including a display of a plurality of different monetary tip amounts;

permitting a player associated with each player station touch screen where a bet was received to select one of the plurality of different monetary tip amounts as the tip to be given;

transferring any monetary amount given as a tip electronically to a fund at least a portion of which is designed to be paid to said dealer; and displaying on an electronic output device positioned at said dealer station a message indicating the fact that a tip to the dealer has been given, the monetary amount of the tip given, and either an indication of the player station where the tip was given or an indication of the player who gave the tip.

2. The method of conducting the operations of a wagering game according to claim 1 wherein said plurality of different monetary tip amounts are displayed on each player station touch screen as representations of chips, wherein a numerical value is displayed substantially in the center of each of said representations of chips, wherein each of said representations of chips displays a numerical value different from the numerical value displayed in each of the others of said plurality of said representations of chips, and wherein the numerical value directly correlates to a monetary amount of a tip.

3. The method of conducting the operations of a wagering game according to claim 2 wherein the tip is given to said dealer by a player either touching or causing to be touched a selected one of the representations of chips displayed on the associated player station touch screen.

4. The method of conducting the operations of a wagering game according to claim 1 further comprising:

maintaining a running total of all the tips given to said dealer from all of said players.

5. The method of conducting the operations of a wagering game according to claim 1 further comprising:

displaying the monetary amount of a player's credit available for wagering and tipping in connection with the wagering game on the player's associated player station touch screen; and deducting the monetary amount given as a tip by a player to said dealer from the monetary amount of the player's credit displayed on the player's associated player station touch screen.

6. The method of conducting the operations of a wagering game according to claim 1 further comprising:

displaying on each player station touch screen a tip box area, and wherein a plurality of different monetary tip amounts are displayed on each player station touch screen as representations of chips, wherein a numerical value is displayed substantially in the center of each of representations of said chips, wherein each of said representations of chips displays a numerical value different from the numerical value displayed in each of the others of said plurality of said representations of chips, wherein the numerical value directly correlates to a monetary amount of a tip, and wherein a tip is given by the player to said dealer by a player either touching or causing to be touched a selected one of the representations of chips on the associated player station touch screen and dragging the selected representation of a chip into the tip box area.

7. The method of conducting the operations of a wagering game according to claim 6 wherein the selected representation of a chip disappears upon being dragged into the tip box area and being released.

8. The method of conducting the operations of a wagering game according to claim 1 wherein some of the plurality of player stations are located within a casino, and some of the plurality of player stations are located outside of the casino.

9. A method of conducting the operations of a wagering game comprising:

providing a dealer station adapted to facilitate a live human dealer in conducting the operations of the wagering game, said dealer station including a dealer touchscreen;

providing a plurality of player stations, each of said player stations physically separate and spaced from said dealer station each of said player stations including a touch screen by which an associated player may participate in the wagering game;

allowing a player to play the wagering game only from an associated one of said player stations;

step for initiating a countdown by the activation of a virtual bets allowed button on the dealer touchscreen;

only during the countdown, receiving from at least one player via an associated player station touch screen a bet for said at least one player to participate in the wagering game;

only after the countdown, having said dealer start conducting the wagering game at said dealer station: transmitting information essential to the play of the game between the dealer station and the plurality of player stations solely electronically;

step for displaying on each player station touch screen where a bet was received a plurality of different values of tips from which a player may select as a tip to be given to said dealer; and step for permitting a player associated with each player station touch screen where a bet was received to select one of the plurality of tip values as a tip for said dealer.

10. The method of conducting the operations of a wagering game according to claim 9 further comprising:

step for enabling said dealer to give acknowledgement to a player who has given a tip to said dealer.

11. The method of conducting the operations of a wagering game according to claim 9 further comprising:

step for distributing to said dealer the tip given to said dealer.

12. The method of conducting the operations of a wagering game according to claim 9 wherein some of the plurality of player stations are located within a casino, and some of the plurality of player stations are located outside the casino.

13. The method of conducting the operations of a wagering game according to claim 9 further comprising:

step for notifying a player associated with each player station of the countdown.

14. The method of conducting the operations of a wagering game according to claim 9 further comprising preventing the receipt of a bet at any time other than during the countdown.

15. A method of conducting the operations of a wagering game, the method comprising:

providing a dealer station adapted to facilitate a live human dealer in dealing physical cards, the dealer station including a dealer touchscreen;

providing a plurality of player stations, each of said player stations physically separate and spaced from said dealer station and each of said player stations each possessing a player touchscreen by which an associated player may participate in the game by placing a bet;

allowing a player to play the wagering game only from an associated one of said player stations;

displaying on the dealer touchscreen a virtual bets allowed button, the touching of which will initiate a first countdown displayed on each player touchscreen;

causing the virtual bets allowed button to be touched by the live dealer;

after the touching of the virtual bets allowed button, receiving from at least one of a plurality of players via an associated player touchscreen a bet for the at least one player to participate in the game;

when the first countdown has been completed, visually displaying on the dealer touchscreen a signal for the live dealer to begin an initial game sequence performed at the dealer station by distributing physical cards;

initiating via the live human dealer the initial game sequence;

displaying a visual representation of the initial game sequence on each of the associated player touchscreens where a player placed a bet to participate in the game;

completing the play of the game for each player who placed a bet;

determining a game outcome for the bet placed by each player;

displaying information regarding the game outcome on each of the associated player touchscreens where a player placed a bet;

step for displaying on each player station touch screen where a wager was received a plurality of different values of tips from which a player may select as a tip to be given to said dealer; and step for permitting a player associated with each player station touch screen where a wager was received to select one of the plurality of tip values as a tip for said dealer.

16. The method of conducting the operations of a wagering game according to claim 15 further comprising:

step for enabling said dealer to give acknowledgement to a player who has given a tip to said dealer.

17. The method of conducting the operations of a wagering game according to claim 15 further comprising:

step for distributing to said dealer the tip given to said dealer.

18. The method of conducting the operations of a wagering game according to claim 15 wherein some of the plurality of player stations are located within a casino, and some of the plurality of player stations are located outside the casino.

19. The method of conducting the operations of a wagering game according to claim 15 further comprising:

step for notifying a player associated with each player station of the countdown.

20. The method of conducting the operations of a wagering game according to claim 15 further comprising preventing the receipt of a bet at any time other than during the countdown.

* * * * *